US007136496B2

(12) United States Patent
van Halteren et al.

(10) Patent No.: US 7,136,496 B2
(45) Date of Patent: Nov. 14, 2006

(54) ELECTRET ASSEMBLY FOR A MICROPHONE HAVING A BACKPLATE WITH IMPROVED CHARGE STABILITY

(75) Inventors: Aart Z. van Halteren, Hobrede (NL); Roelof A. Marissen, Den Haag (NL); Michel Bosman, Delft (NL); Dion I. de Roo, Voorburg (NL); Raymond Mögelin, Alkmaar (NL); Michel de Nooij, Aalsmeer (NL)

(73) Assignee: Sonion Nederland B.V., Amsterdam (NL)

( * ) Notice: Subject to any disclaimer, the term of this patent is extended or adjusted under 35 U.S.C. 154(b) by 416 days.

(21) Appl. No.: 10/266,799
(22) Filed: Oct. 8, 2002

(65) Prior Publication Data

US 2003/0076970 A1 Apr. 24, 2003

Related U.S. Application Data

(63) Continuation-in-part of application No. 10/210,571, filed on Aug. 1, 2002, now Pat. No. 6,937,735, which is a continuation-in-part of application No. 10/124,683, filed on Apr. 17, 2002, now Pat. No. 7,062,058.

(60) Provisional application No. 60/301,736, filed on Jun. 28, 2001, provisional application No. 60/284,741, filed on Apr. 18, 2001.

(51) Int. Cl.
*H04R 25/00* (2006.01)

(52) U.S. Cl. ..... 381/174; 381/190; 381/191

(58) Field of Classification Search ..... 381/173, 381/174, 190, 191; 367/140, 181, 170; 29/25.41, 29/25.42; 307/400
See application file for complete search history.

(56) References Cited

U.S. PATENT DOCUMENTS 2,490,236 A 12/1949 Shaper ..... 171/327

(Continued)

FOREIGN PATENT DOCUMENTS

DE 43 29 993 A1 9/1995

(Continued)

OTHER PUBLICATIONS

Microtronic, Product News and drawing for "Cylindrical Microphone Series 8000," 2 pages (Apr. 19, 2001).

*Primary Examiner*—Curtis Kuntz
*Assistant Examiner*—Tuan Duc Nguyen
(74) *Attorney, Agent, or Firm*—Jenkens & Gilchrist

(57) ABSTRACT

The present invention relates to a microphone that includes a housing and a diaphragm and backplate located with the housing. The housing has a sound port for receiving the sound. The diaphragm undergoes movement relative to the backplate, which it opposes, in response to the incoming sound. The backplate has a charged layer with a first surface that is exposed to the diaphragm and a second surface opposite the first surface. The backplate further includes a conductor for transmitting a signal from the backplate to electronics in the housing. The conductor faces the second surface of the charged layer. To minimize the charge degradation created by contact with or infiltration of foreign materials, the first surface, the second surface, or both surfaces of the charged layer includes a protective layer thereon.

12 Claims, 16 Drawing Sheets

U.S. PATENT DOCUMENTS

| | | | | |
|---|---|---|---|---|
| 3,068,446 | A | 12/1962 | Ehrlich et al. | 340/8 |
| 3,663,768 | A | 5/1972 | Madsen et al. | 179/111 E |
| 3,775,572 | A | 11/1973 | Ishibashi et al. | 179/111 |
| 4,063,049 | A | 12/1977 | Pipitone et al. | 179/110 A |
| 4,442,324 | A | 4/1984 | Blanchard et al. | 179/111 E |
| 4,550,227 | A | 10/1985 | Topholm | 179/107 E |
| 4,607,720 | A | 8/1986 | Hardt | 181/135 |
| 4,634,815 | A | 1/1987 | Marquis | 387/68.4 |
| 4,736,430 | A | 4/1988 | Schröder | 381/68.6 |
| 4,739,512 | A | 4/1988 | Hartl et al. | 381/68.6 |
| 4,764,690 | A | 8/1988 | Murphy et al. | 307/400 |
| 4,850,023 | A | 7/1989 | Yarush | 381/67 |
| 4,852,177 | A | 7/1989 | Ambrose | 381/154 |
| 4,903,308 | A | 2/1990 | Paddock et al. | 381/202 |
| 4,993,072 | A | 2/1991 | Murphy | 381/113 |
| 5,048,090 | A | 9/1991 | Geers | 381/68.6 |
| 5,097,515 | A | 3/1992 | Baba | 381/191 |
| 5,208,789 | A * | 5/1993 | Ling | 367/181 |
| 5,220,612 | A | 6/1993 | Tibbetts et al. | 381/68 |
| 5,335,286 | A | 8/1994 | Carlson et al. | 381/191 |
| 5,373,555 | A | 12/1994 | Norris et al. | 379/430 |
| 5,408,534 | A | 4/1995 | Lenzini et al. | 381/191 |
| 5,530,763 | A | 6/1996 | Aebi et al. | 381/69 |
| 5,548,658 | A | 8/1996 | Ring et al. | 381/191 |
| 5,570,428 | A | 10/1996 | Madaffari et al. | 381/191 |
| 5,619,476 | A * | 4/1997 | Haller et al. | 367/181 |
| 5,740,261 | A | 4/1998 | Loeppert et al. | 381/168 |
| 5,828,766 | A | 10/1998 | Gallo | 381/190 |
| 5,859,916 | A | 1/1999 | Ball et al. | 381/326 |
| 5,881,158 | A | 3/1999 | Lesinski et al. | 381/174 |
| 6,075,869 | A | 6/2000 | Killion et al. | 381/313 |

FOREIGN PATENT DOCUMENTS

| | | | |
|---|---|---|---|
| JP | 11266499 | A | 9/1999 |
| JP | 2000050394 | A | 2/2000 |
| WO | WO 00/41432 | A2 | 7/2000 |
| WO | WO 01/43489 | A2 | 6/2001 |

* cited by examiner

ELECTRET ASSEMBLY FOR A MICROPHONE HAVING A BACKPLATE WITH IMPROVED CHARGE STABILITY

RELATED APPLICATIONS

This application is a continuation-in-part of U.S. patent application Ser. No. 10/210,571, filed Aug. 1, 2002, now U.S. Pat. No. 6,937,735; which is a continuation-in-part of U.S. patent application Ser. No. 10/124,683, filed Apr. 17, 2002, now U.S. Pat. No. 7,062,058; which claims the benefit of priority of U.S. Provisional Patent Application Nos. 60/301,736, filed Jun. 28, 2001, and 60/284,741, filed Apr. 18, 2001. These four applications are incorporated herein by reference in their entireties.

FIELD OF THE INVENTION

The present invention relates generally to electroacoustic transducers and, in particular, to a microphone having an improved structure for its electret assembly, yielding enhanced performance over the operating life of the microphone.

BACKGROUND OF THE INVENTION

Miniature microphones, such as those used in hearing aids, convert acoustical sound waves into an electrical signal which is processed (e.g, amplified) and sent to a receiver of the hearing aid The receiver then converts the processed signal to acoustical sound waves that are broadcast towards the eardrum.

In one typical microphone, a moveable diaphragm and a rigid backplate, often collectively referred to as an electret assembly, convert the sound waves into the audio signal The diaphragm is usually a polymer, such as mylar, with a metallic coating The backplate usually contains a charged dielectric material, such as Teflon, laminated on a metallic carrier which is used for conducting the signal from the electret assembly to other circuitry that processes the signal.

The backplate and diaphragm are separated by a spacer that contacts these two structures at their peripheries. Because the dimensions of the spacer are known, the distance between the diaphragm and the backplate at their peripheries is known. When the incoming sound causes the diaphragm to move relative to the charged backplate, a signal is developed that corresponds to the incoming sound If the charge on the backplate changes, the signal changes.

Because the charge on the backplate is induced in the material of the backplate, usually by corona charging, the charge can slowly decay over time. Additionally, foreign material that comes in contact with the charged layer can accelerate the charge degradation as the foreign material may have a charge that affects the charged layer. For example, the charge can be reduced by condensed vapor or dirt contacting the charged layer of the backplate Second, the conductive material on the conductive member that is in contact with the charged layer can release positive (i.e., holes) or negative (i e., electrons) charges into the charged layer, causing a change in the charge. This effect is at least, in part, due to the surface topography of the conductive layer. Furthermore, extreme ambient conditions, such as temperature and humidity, and light (especially UV light) can also cause a change in the charge A need exists for a microphone that has a backplate that is less sensitive to extreme environmental conditions and the infiltration of charges caused by exposure to foreign materials, thereby yielding a more stable charge over the operating life of the backplate.

SUMMARY OF THE INVENTION

The present invention relates to a backplate that is used in a microphone that converts sound into an electrical output The microphone includes a housing and a diaphragm and backplate located with the housing. The housing has a sound port for receiving the sound. The diaphragm undergoes movement relative to the backplate, which it opposes, in response to the incoming sound. The backplate has a charged layer with a first surface that is exposed to the diaphragm and a second surface opposite the first surface. The backplate further includes a conductor for transmitting a signal from the backplate to electronics in the housing. The conductor faces the second surface of the charged layer.

To minimize the charge degradation due to physical contact with foreign materials, the first surface of the charged layer includes a protective layer thereon to inhibit physical contact between the charged layer and foreign materials, such as moisture and dirt. The protective layer on the first surface is preferably a hydrophobic material to minimize the water absorption To minimize the charge degradation due to the infiltration of positive charges (i.e., holes) or negative charges (i.e., electrons) from the conductor (positive or negative depending on the polarity of the charged layer), the second surface of the charged layer includes a protective layer thereon. When the charged layer is negatively charged, the protective layer on the second surface preferably has a low "hole" conductivity to resist the movement of holes from the conductor.

In one preferred embodiment, both the first and second surfaces of the charged layer have a protective layer. In another preferred embodiment, only the first surface of the charged layer has a protective layer. In yet another preferred embodiment, only the second surface of the charged layer has a protective layer.

Recognizing that a conductor surface that is rougher may enhance its ability to allow a charge to flow into an adjacent charged layer, the present invention also contemplates processing the conductor's surface to smooth the sharp micropeaks that may be present on that surface. The smoother surface may be brought about by additional vacuum deposition of metal to the initial conductive layer, galvanic metal coating, and/or polishing.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

Figure 1:
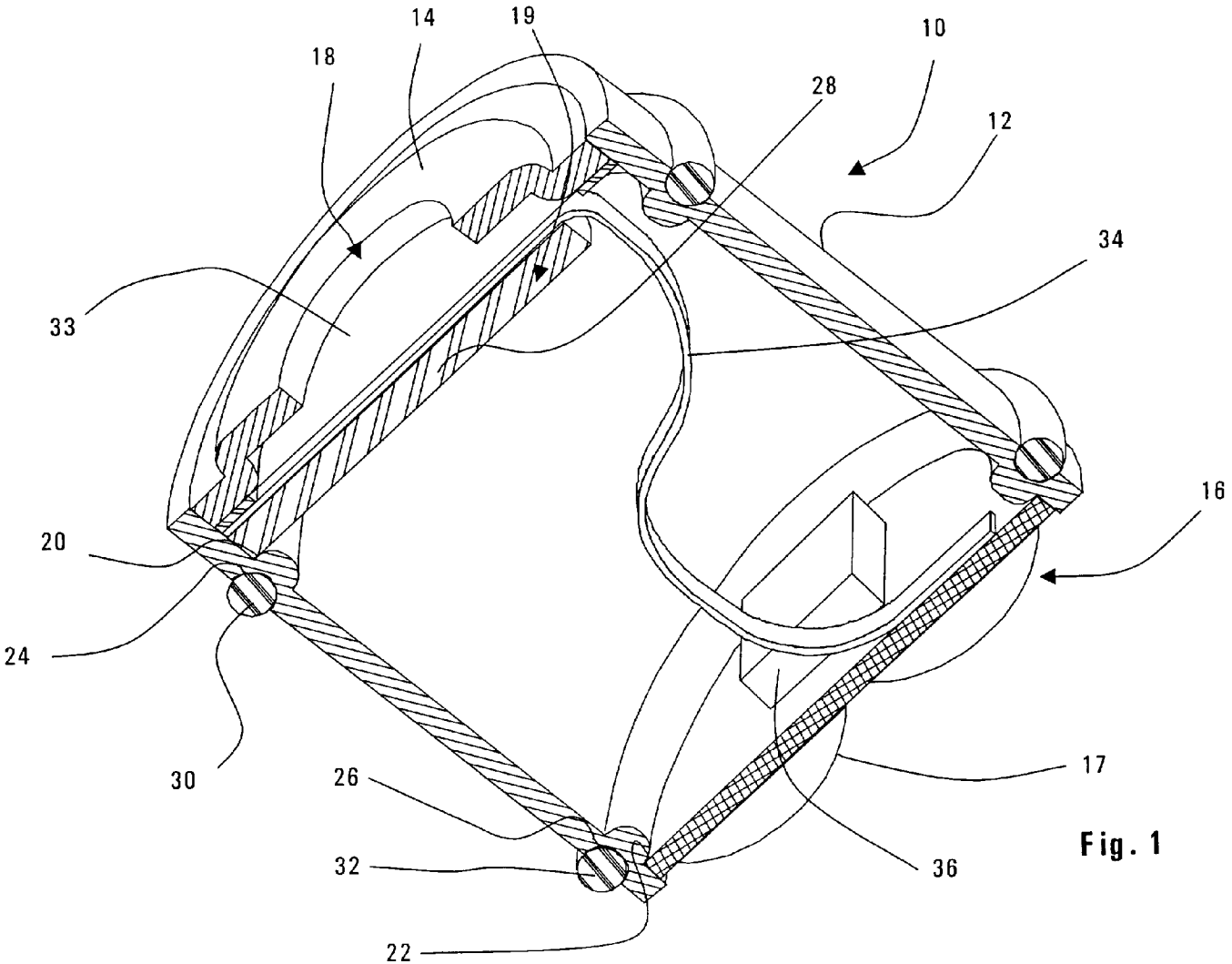
FIG. 1 is a sectional isometric view of the cylindrical microphone according to the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Referring to FIG. 1, a microphone 10 according to the present invention includes a housing 12 having a cover assembly 14 at its upper end and a printed circuit board (PCB) 16 at its lower end While the housing 12 has a cylindrical shape, it can also be a polygonal shape, such as one that approximates a cylinder. In one preferred embodiment, the axial length of the microphone 10 is about 2.5 mm, although the length may vary depending on the output response required from the microphone 10.

The PCB 16 includes three terminals 17 (see FIG. 2) that provide a ground, an input power supply, and an output for the processed electrical signal corresponding to a sound that is transduced by the microphone 10. The sound enters the sound port 18 of the cover assembly 14 and encounters an electret assembly 19 located a short distance below the sound port 18. It is the electret assembly 19 that transduces the sound into the electrical signal.

The microphone 10 includes an upper ridge 20 that extends circumferentially around the interior of the housing 12 It further includes a lower ridge 22 that extends circumferentially around the interior of the housing 12 The ridges 20, 22 can be formed by circumferential recesses 24 (i.e, an indentation) located on the exterior surface of the housing 12. The ridges 20, 22 do not have to be continuous, but can be intermittently disposed on the interior surface of the housing 12. As shown, the ridges 20, 22 have a rounded cross-sectional shape.

The upper ridge 20 provides a surface against which a portion of the electret assembly 19 is positioned and mounted within the housing 12. As shown, a backplate 28 of the electret assembly 19 engages the upper ridge 20. Likewise, the lower ridge 22 provides a surface against which the PCB 16 is positioned and mounted within the housing 12. The ridges 20, 22 provide a surface that is typically between 100–200 microns in radial length (i e., measured inward from the interior surface of the housing 12) for supporting the associated components.

Additionally, the recesses 24, 26 in the exterior surface of the housing 12 retain O-rings 30, 32 that allow the microphone 10 to be mounted within an external structure. The O-rings 30, 32 may be comprised of several materials, such as a silicon or a rubber, that allow for a loose mechanical coupling to the external structure, which is typically the faceplate of a hearing aid or listening device. Thus, the present invention contemplates a novel microphone comprising a generally cylindrical housing having a first ridge at a first end and a second ridge at a second end A printed circuit is board mounted within the housing on the first ridge. An electret assembly is mounted within the housing on the second ridge for converting a sound into an electrical signal.

The backplate 28 includes an integral connecting wire 34 that electrically couples the electret assembly 19 to the electrical components on the PCB 16. As shown, the integral connecting wire 34 is coupled to an integrated circuit 36 located on the PCB 16 The electret assembly 19, which includes the backplate 28 and a diaphragm 33 positioned at a known distance from the backplate 28, receives the sound via the sound port 18 and transduces the sound into a raw audio signal The integrated circuit 36 processes (e g., amplifies) the raw audio signals produced within the electret assembly 19 into audio signals that are transmitted from the microphone 10 via the output terminal 17. As explained in more detail below, the integral connecting wire 34 results in a more simplistic assembly process because only one end of the integral connecting wire 34 needs to be attached to the electrical components located on the PCB 16 In other words, the integral connecting wire 34 is already in electrical contact with the backplate 28 because it is "integral" with the backplate 28.

Figure 2:
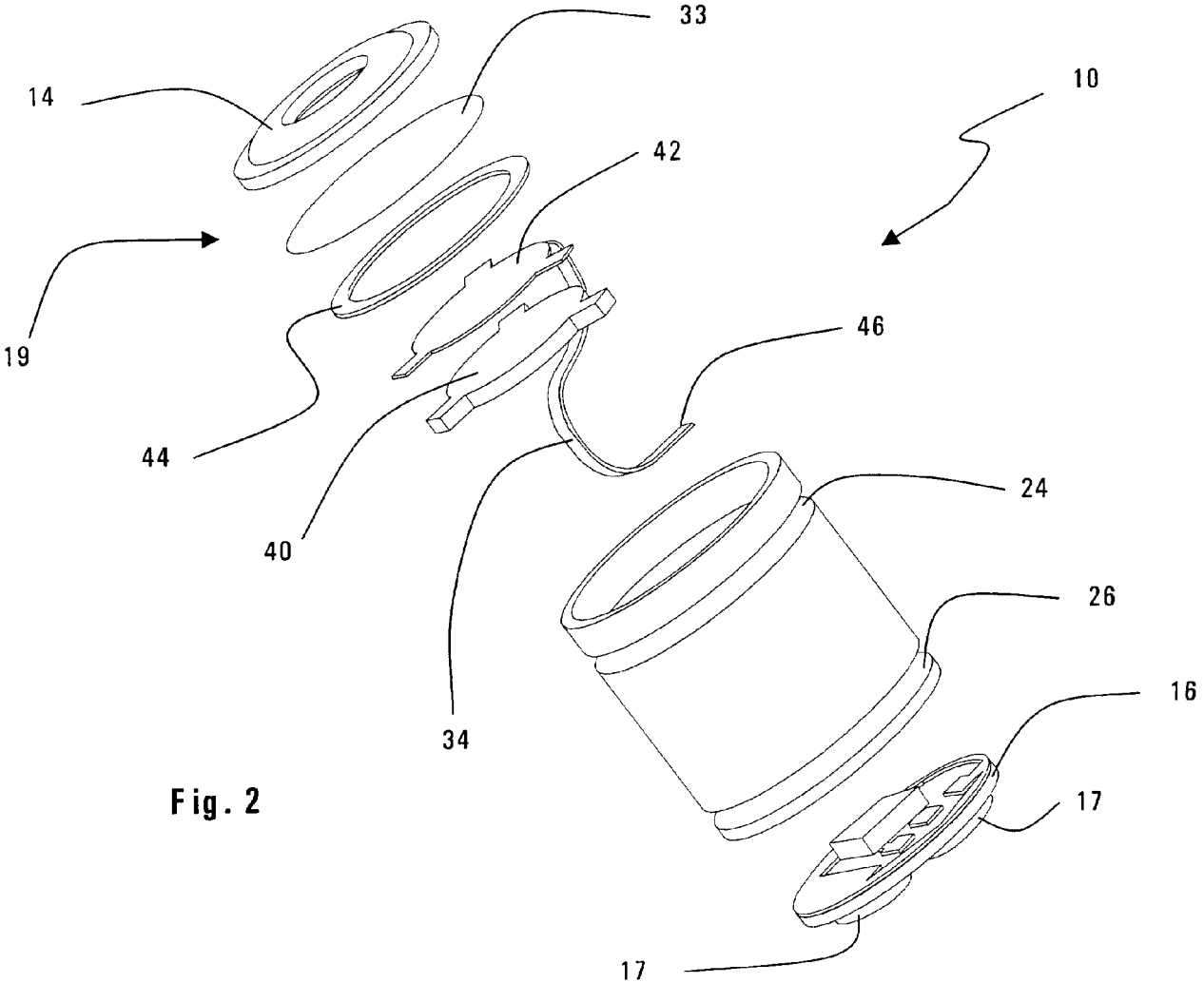
FIG. 2 is an exploded isometric view of the microphone of FIG. 1.

FIG. 2 reveals further details of the electret assembly 19. Specifically, the backplate 28 includes a base layer 40 which is typically made of a polyimide (eg., Kapton) and a charged layer 42. The charged layer 42 is typically a charged Teflon (e.g., fluorinated ethylene propylene) and also includes a metal (e.g., gold) coating for transmitting signals from the charged layer 42. The charged layer 42 is directly exposed to the diaphragm 33 and is separated from the diaphragm 33 by an isolating spacer 44. The thickness of the isolating spacer 44 determines the distance between the charged layer 42 of the backplate 28 and the diaphragm 33. The diaphragm 33 can be polyethylene terephthalate (PET), having a gold layer that is directly exposed to the charged layer 42 of the backplate 28. Or, the diaphragm 33 may be a pure metallic foil The isolating spacer 44 is typically a PET or a polyimide. The backplate 28 will be discussed in more detail below with respect to FIGS. 5A and 5B. Additionally, while the electret assembly 19 has been described with the backplate 28 having the charged layer 42 (i.e., the electret material), the present invention is useful in systems where the diaphragm 33 includes the charged layer and the backplate is metallic.

Figure 3:
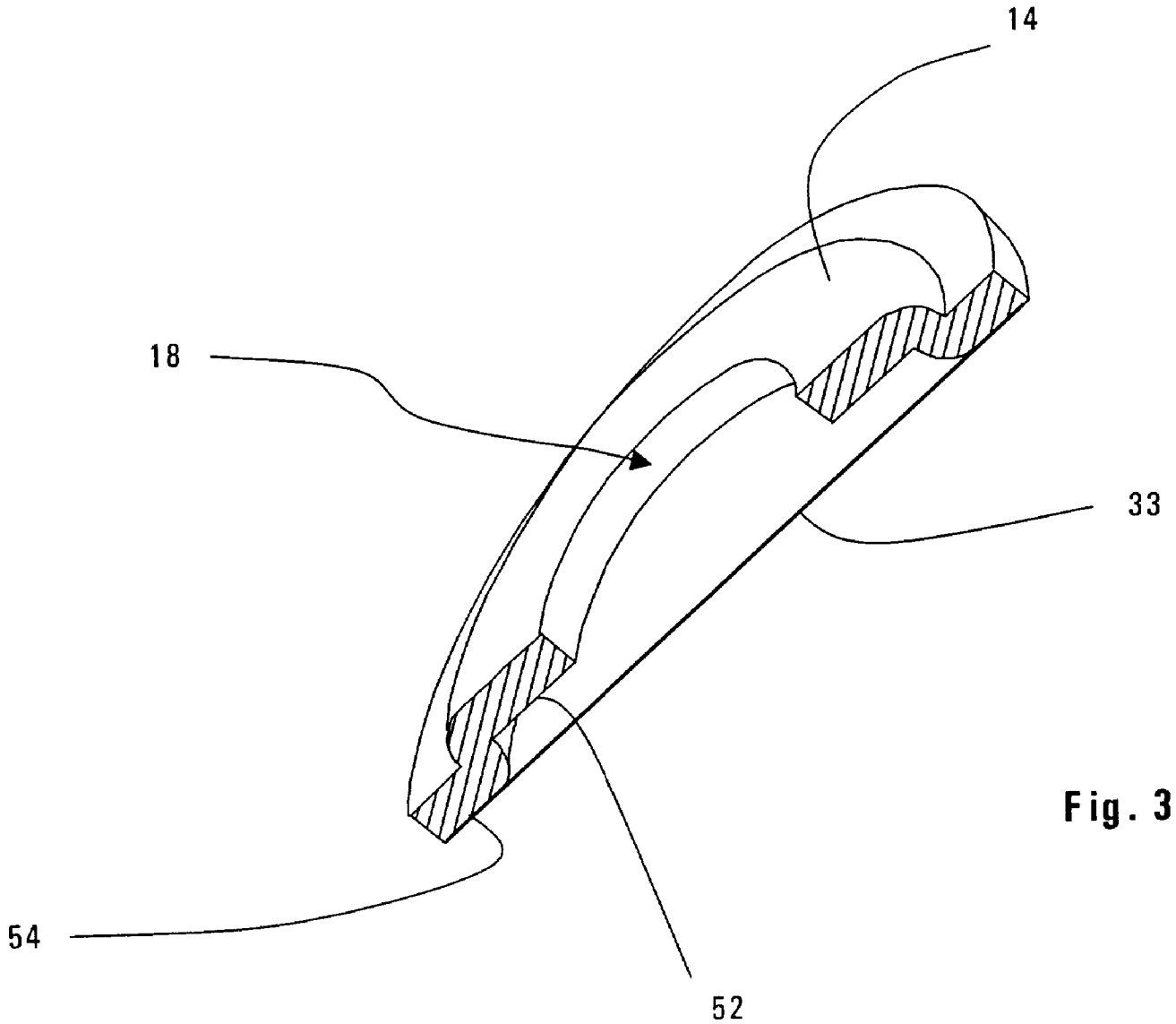
FIG. 3 is a sectional view of the cover assembly of the microphone of FIG. 1

FIG. 3 illustrates the cover assembly 14 that serves as the carrier for the diaphragm 33, provides protection to the diaphragm 33, and receives the incoming sound. The cover assembly 14 includes a recess 52 located in the middle portion of the cover assembly 14. The sound port 18 is located generally at the midpoint of the recess 52. While the sound port 18 is shown as a simple opening, it can also include an elongated tube leading to the diaphragm 33. Furthermore, the cover assembly 14 may include a plurality of sound ports. The recess 52 defines an internal boss 54 located along the circular periphery of the cover assembly 14 The diaphragm 33 is held in tension at the boss 54 around the periphery of the cover assembly 14. The diaphragm 33 is typically attached to the boss 54 through the use of an adhesive. The adhesive is provided in a very thin layer so that electrical contact is maintained between the cover assembly 14 and the diaphragm 33. Alternatively, the glue or adhesive may be conductive to maintain electrical connection between the diaphragm 33 and the cover assembly 14. Because the cover assembly 14 includes the diaphragm 33, the diaphragm 33 is easy to transport and assemble into the housing 12.

In addition to the fact that the cover assembly 14 provides protection to the diaphragm 33, the recess 52 of the cover assembly 14 defines a front volume for the microphone 10 located above the diaphragm 33. Furthermore, the width of the boss 54 is preferably minimized to allow a greater portion of the area of the diaphragm 33 to move when subjected to sound. A smaller front volume is preferred for space efficiency and performance, but at least some front volume is needed to provide protection to the moving diaphragm In one embodiment, the diaphragm 33 has a thickness of approximately 1.5 microns and a height of the front volume of approximately 50 microns The overall diameter of the diaphragm 33 is 2 3 mm, and the working portion of the diaphragm 33 that is free of contact with the annular boss 54 is about 1.9 mm.

The cover assembly 14 fits within the interior surface of the housing 12 of the microphone 10, as shown best in FIG. 1 The cover assembly 14 is held in place on the housing 12 through a weld bond. To enhance the electrical connection, the housing 12 and/or cover assembly 14 can be coated with nickel, gold, or silver. Consequently, there is an electrical connection between the diaphragm 33 and the cover assembly 14, and between the cover assembly 14 and the housing 12

Thus, FIGS. 1–3 disclose an assembling methodology for a microphone that includes positioning a backplate into a housing of the microphone such that the backplate rests against an internal ridge in the housing. The assembly includes the positioning of a spacer member in the housing adjacent to the backplate, and installing an end cover assembly with an attached diaphragm onto the housing. This installing step includes sandwiching the spacer member and the backplate between the internal ridge and the end cover assembly. Stated differently, the invention of FIGS. 1–3 is a microphone for converting sound into an electrical signal. The microphone includes a housing having an end cover with a sound port. The end cover is a separate component from the housing. The housing has an internal ridge near the end cover and a backplate is positioned against the internal ridge. The diaphragm is directly attached to the end cover. A spacer is positioned between the backplate and the diaphragm. When the end cover with the attached diaphragm is installed in the housing, the spacer and backplate are sandwiched between the internal ridge and the end cover.

Figure 4:
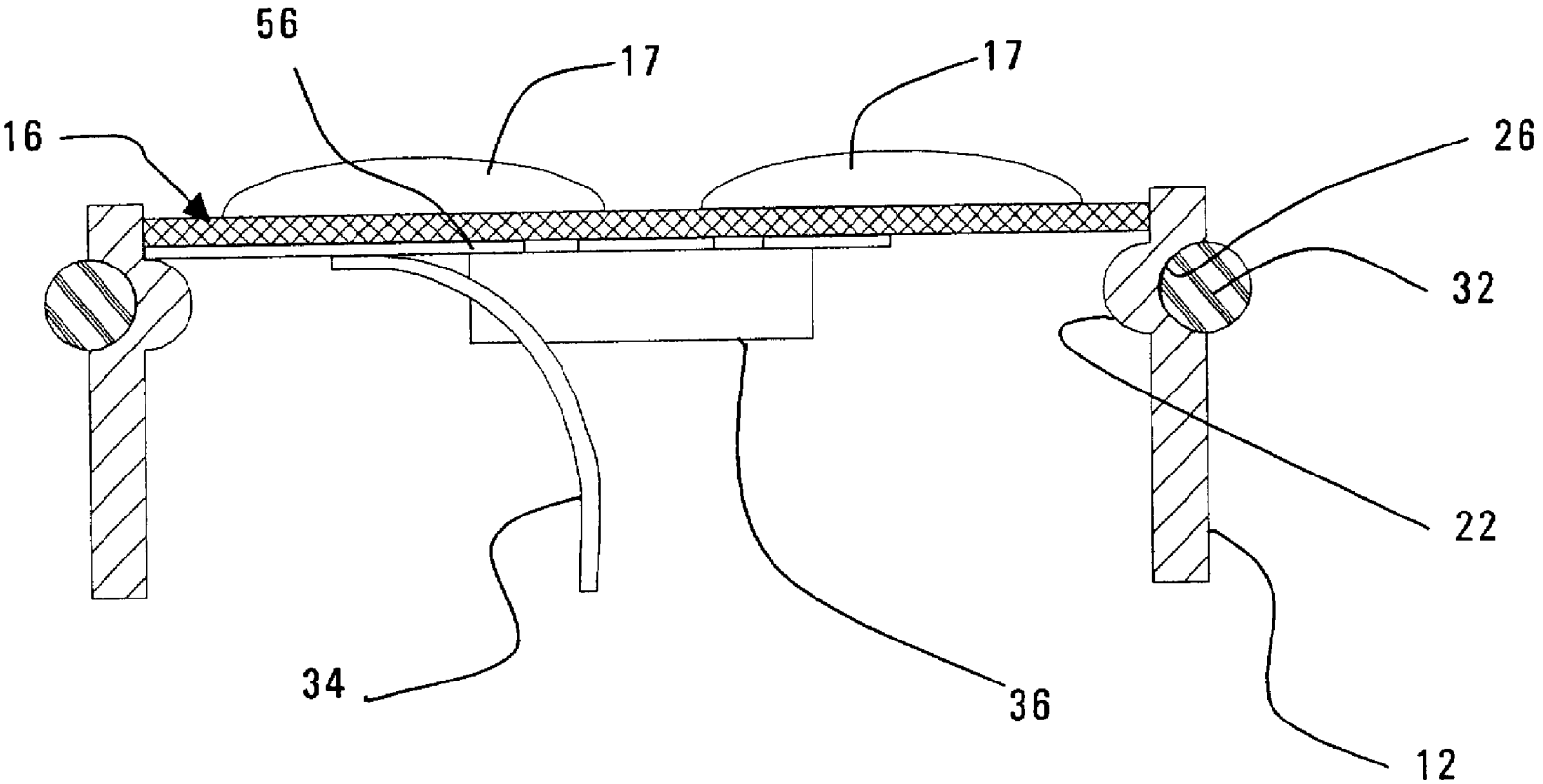
FIG. 4 is a sectional view of the printed circuit board mounted within the housing of the microphone of FIG. 1.

FIG. 4 is a cross-section along the lower portion of the microphone 10 illustrating the mounting of the PCB 16 on the lower ridge 22 of the housing 12. The integral connecting wire 34 extends from the backplate 28 (FIGS. 1 and 2) and is in electrical connection with the PCB 16 at a contact pad 56. This electrical connection at the contact pad 56 may be produced by double-sided conductive adhesive tape, a drop of conductive adhesive, heat sealing, or soldering.

The periphery of the PCB 16 has an exposed ground plane that is in electrical contact with the ridge 22 or the housing 12 immediately adjacent to the ridge 22. Accordingly, the same ground plane used for the integrated circuit 36 is also in contact with the housing 12. As previously mentioned with respect to FIG. 3, the cover assembly 14 is in electrical contact with the housing 12 via a weld bond and also the diaphragm 33. Because the diaphragm 33, the cover assembly 14, the housing 12, the PCB 16, and the integrated circuit 36 are all connected to the same ground, the raw audio signal produced from the backplate 28 and the output audio signal at the output terminal 17 are relative to the same ground.

The PCB 16 is shown with the integrated circuit 36 that may be of a flip-chip design configuration The integrated circuit 36 can process the raw audio signals from the backplate 28 in various ways. Furthermore, the PCB 16 may also have an integrated A/D converter to provide a digital signal output from the output terminal 17.

Figure 5B:
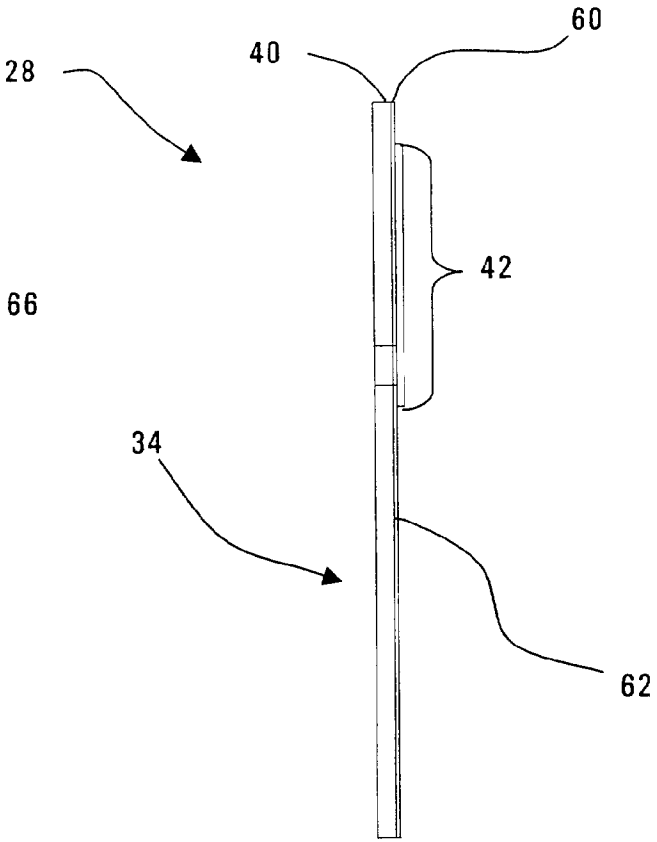
FIGS. 5A and 5B illustrate a top view and a side view of the backplate prior to being assembled into the cylindrical microphone housing of FIG. 1.
Figure 5A:
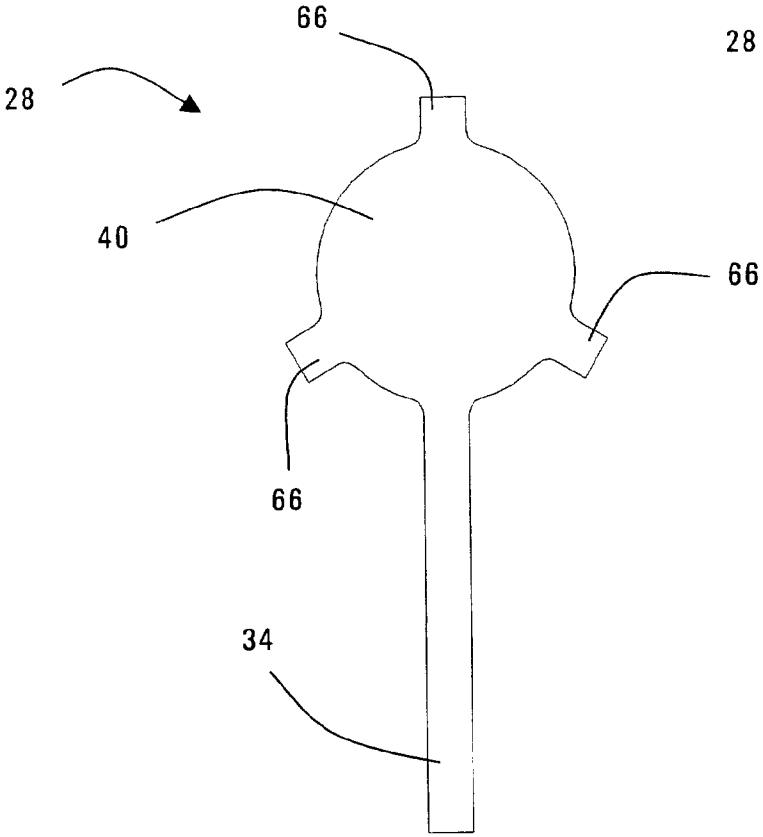

FIGS. 5A and 5B illustrate the backplate 28 in a top view and a side view, respectively, prior to assembly into the housing 12. The base layer 40 is the thickest layer and is typically comprised of a polymeric material such as a polyimide. The charged layer 42, which can be a layer of charged Teflon, is separated from the base layer 40 by a thin gold coating 60 that is on one surface of the base layer 40. To construct the backplate 28, the gold coating 60 on the base layer 40 is laminated to the charged layer 42, which is at that point "uncharged." After the lamination, the charged layer 42 is subjected to a process in which it becomes "charged." In one embodiment, the charged layer 42 is about 25 microns of Teflon, the gold layer is about 0.09 microns, and the base layer 40 is about 125 microns of Kapton.

The thin gold coating 60 has an extending portion 62 that provides the signal path for the integral connecting wire 34 leading from the backplate 28 to the PCB 16 The extending gold portion 62 is carried on the base layer 40. The integral connecting wire 34 has a generally rectangular cross-section. While the integral connecting wire 34 is shown as being flat, it can easily be bent to the shape that will accommodate its installation into the housing 12 and its attachment to the PCB 16.

Alternatively, the charged layer 42 may have the gold coating In this alternative embodiment, the base layer 40 can terminate before extending into the integral connecting wire 34, and the charged layer 42 can extend with the gold coating 60 so as to serve as the primary structure providing strength to the extending portion 62 of the gold coating 60

To position the backplate 28 properly within the housing 12, the base layer 40 includes a plurality of support members 66 that extend radially from the central portion of the base layer 40. The support members 66 engage the upper ridge 20 in the housing 12. Consequently, the backplate 28 is provided with a three point mount inside the housing 12.

A microphone 10 according to the present invention has less parts and is easier to assemble than existing microphones Once the backplate 28 and the spacer 44 are placed on the upper ridge 20, the cover assembly 14 fits within the housing 12 and "sandwiches" the electret assembly 19 into place. The cover assembly 14 can then be welded to the housing 12. The free end 46 (FIG. 2) of the integral connecting wire 34 is then electrically coupled to the PCB 16, and the PCB 16 is then fit into place against the lower ridge 22. The integral connecting wire 34 preferably has a length that is larger than a length of the housing 12 to allow the integral connecting wire 34 to extend through the housing 12 and to be attached to the PCB 16 while the PCB 16 is outside of the housing 12. The PCB 16 is held on the lower ridge by placing dots of silver adhesive on the lower ridge 22. To ensure a tight seal and to hold the PCB 16 in place, a sealing adhesive, such as an Epotek adhesive, is then applied to the PCB 16.

Figure 6:
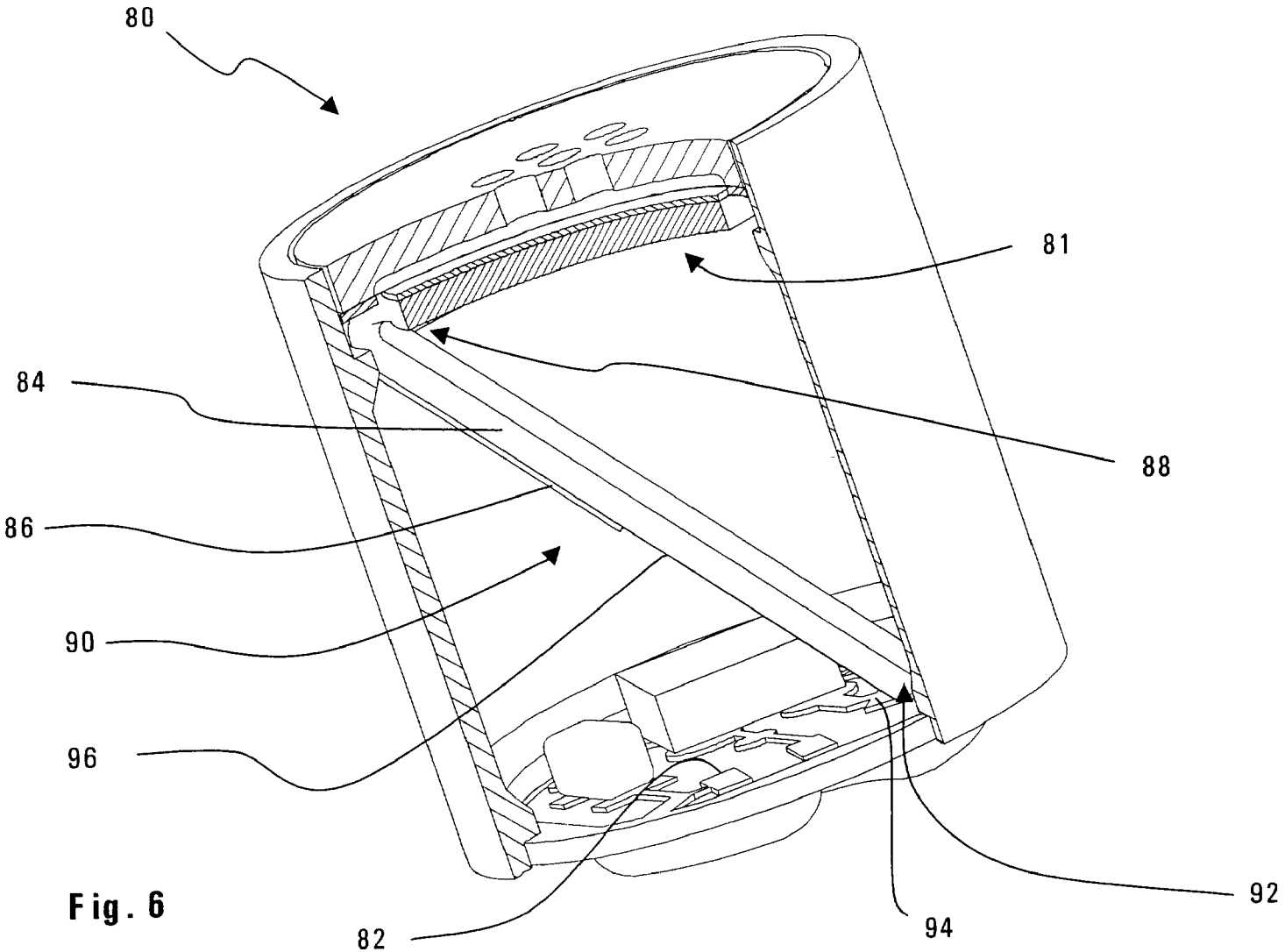
FIG. 6 illustrates an alternative embodiment where the integral connecting wire of the backplate provides a contact pressure engagement with the printed circuit board.

FIG. 6 illustrates a further embodiment of the present invention in which a microphone 80 includes an electret assembly 81 that provides a pressure-contact electrical coupling with a printed circuit board 82. While the specific materials can be modified, the electret assembly 81 preferably includes a backplate comprised of a Kapton layer 84, a Teflon layer 86, and a thin metallization (e.g., gold) layer (not shown) between the Kapton layer 84 and the Teflon layer 86, like that which is disclosed in the previous embodiments. A bend region 88 causes an integral connecting wire 90 to extend downwardly from the primary flat region of the backplate that opposes the diaphragm in the electret assembly 81. Because the Kapton layer 84 and the Teflon layer 86 are laminated in a substantially flat configuration, the bend region 88 tends to cause the integral connecting wire 90 to elastically spring upwardly towards the horizontal position. Accordingly, a terminal end 92 of the integral connecting wire 90 is in a contact pressure engagement with a contact pad 94 on the printed circuit board 82

The spring force provided by the bend region 88 can be varied by changing the dimensions of the Kapton layer 84 and the Teflon layer 86. For example, the Kapton layer 84 can be thinned in the bend region 88 to provide less spring force in the integral connecting wire 90 and, thus, provide less force between the terminal end 92 of the integral connecting wire 90 and the contact pad 94. Because the Kapton layer 84 is thicker than the Teflon layer 86, it is the Kapton layer 84 that provides most of the spring force.

Figure 7:
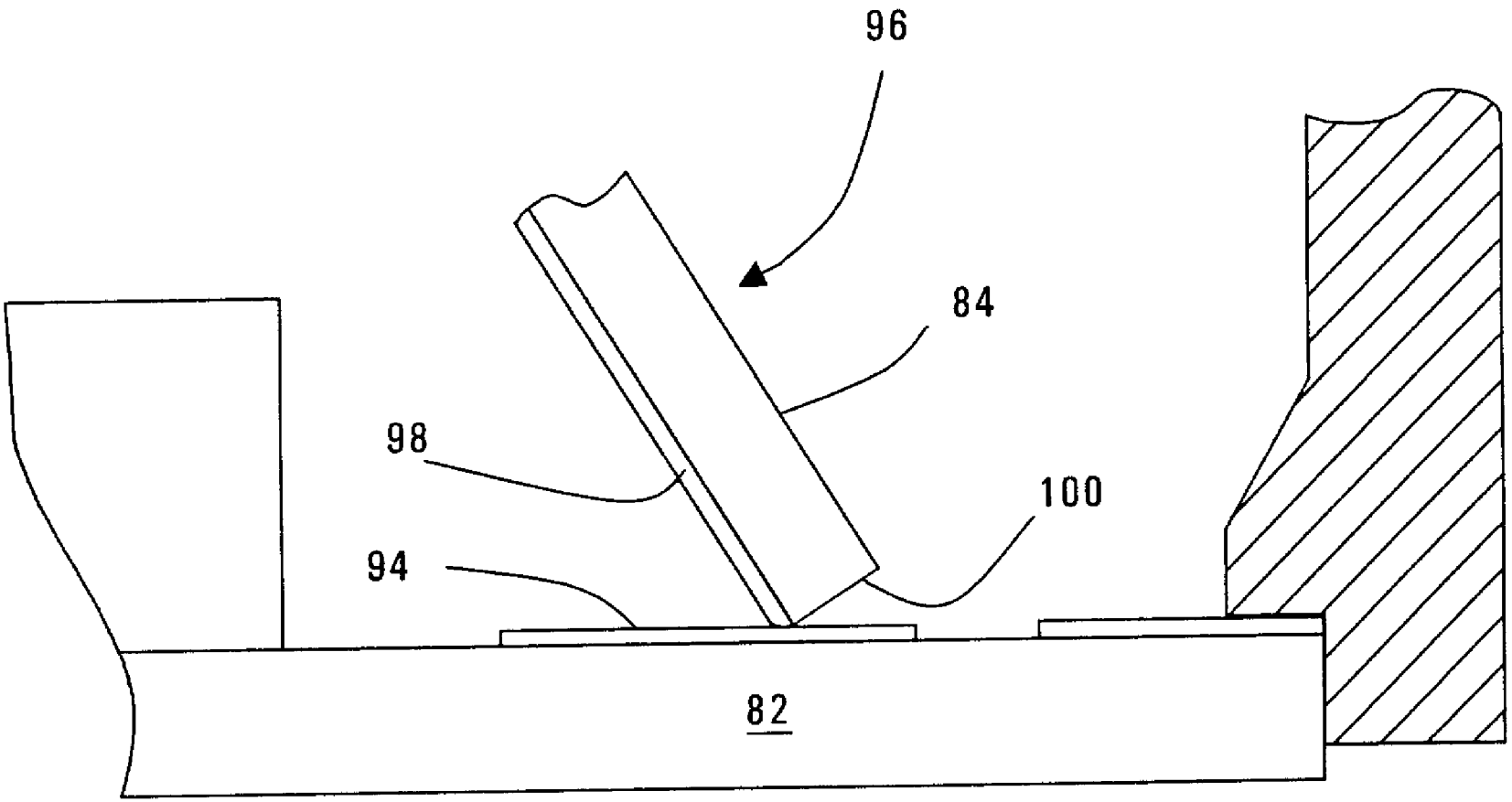
FIG. 7 is a side view of the electrical connection at the printed circuit board for the embodiment of FIG. 6.

To ensure proper electrical contact between the terminal end 92 of the integral connecting wire 90 and the contact pad 94, at least a portion of the end face of the terminal end 92 must have an exposed portion of the metallization layer to make electrical contact with contact pad 94. As shown in FIG. 6, the exposed metallized layer is developed by having a lower region of the Teflon layer 86 removed so that the terminal end 92 includes a metallized portion 96 of the Kapton layer 84. The Teflon layer 86 can terminate at an intermediate point along the length of the integral connection wire 90, but preferably extends beyond the bend region 88 to protect the metallization layer. Further, the Teflon layer 96 may extend along a substantial portion of the length of the integral connecting wire 90 to protect against short-circuiting FIG. 7 illustrates the detailed interaction between the metallized portion 96 of the Kapton layer 84 and the contact pad 94 on the PCB 82. Unlike FIG. 6, the metallization layer 98 is illustrated in FIG. 7 on the Kapton layer 84. Because the backplate is produced by a stamping process from the Kapton side, the metallization layer 98 gets smeared across the end face 100 of the Kapton layer 84 and has a rounded corner. This provides a larger contact area for the metallization layer 98 that helps to ensure proper electrical contact at the contact pad 94.

Figure 8:
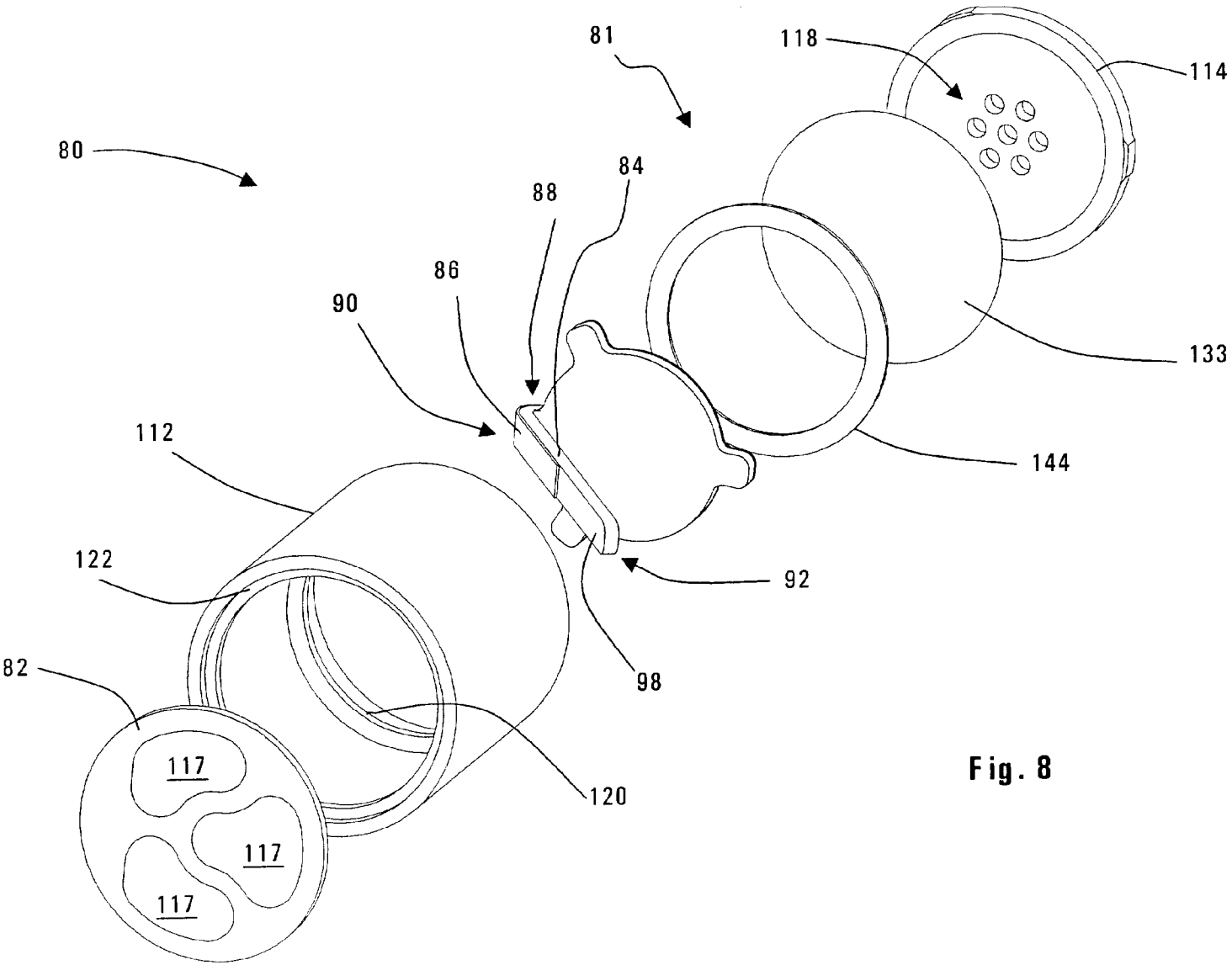
FIG. 8 is an exploded isometric view of the microphone of FIGS. 6 and 7

FIG. 8 illustrates an exploded view of the microphone 80 in FIGS. 6 and 7, and includes the details of the various components. The microphone 80 has the same type of components as the previous embodiment. One end of the housing 112 includes the PCB 82 having the three terminals 117. The PCB 82 rests on a lower ridge 122 in the housing 112. The other end of the housing 112 receives the electret assembly 81. The electret assembly 81 includes the backplate with its integral connecting wire 90, a diaphragm 133, and a spacer 144. The end cover 114, which includes a plurality of openings 118 for receiving the sound, sandwiches the electret assembly 81 against the upper ridge 120 of the housing 112.

In a preferred assembly method, the electret assembly 81 is set in place in the housing 112 with the integral connecting wire 90 bent in the downward position such that an interior angle between the integral connecting wire 90 and the backplate is less than 90 degrees, as shown in FIG. 8. Then, the printed circuit board 82 is moved inwardly to rest on the lower ridge 122 During this step, the printed circuit board 82 is placed in a position that aligns the terminal end 92 of the integral connecting wire 90 with the contact pad 94. The inward movement of the printed circuit board 82 forces the terminal end 92 into a contact pressure engagement with the contact pad 94 Also, a drop of conductive epoxy could be applied to the contact pad 94 on the printed circuit board 82 to ensure a more reliable, long-term connection that may be required for some operating environments. The spacer 144 and the cover 114, including the attached diaphragm 133 force the backplate against the upper ridge 120.

In the arrangement of FIGS. 6–8, the number of steps required in the assembly process is reduced. And, the number of components required for assembly is minimized since it is possible to use no conductive tape or adhesive. Thus, the invention of FIGS. 6–8 includes a method of assembling a microphone, comprising providing an electret assembly, providing a printed circuit board, and electrically connecting the electret assembly and the printed circuit board via a contact pressure engagement that lacks a solder or adhesive bond.

This methodology of assembling a microphone can also be expressed as providing a backplate that includes an integral connecting wire, mounting the backplate within a microphone housing, and electrically connecting the integral connecting wire to an electrical contact pad via an elastic spring force in the integral connecting wire.

The backplates for the embodiments of FIGS. 1–8 may be rigid, but also may be relatively flexible to provide vibration insensitivity When the backplate is rigid, the diaphragm moves relative to the backplate when exposed to external vibrations. This vibration-induced movement of the diaphragm produces a signal that is equivalent to a sound pressure of approximately 50–70 dB SPL per 9.8 $m/s^2$ (per 1 g). The vibration sensitivity relative to the acoustic sensitivity is a function of the effective mass of the diaphragm divided by the diaphragm area This effective mass is the fraction of the physical mass that is actually moving due to vibration and/or sound. This fraction depends only on the diaphragm shape. For a certain shape, the vibration sensitivity of the diaphragm is determined by the diaphragm thickness and the mass density of the diaphragm material. Thus, a reduction in vibration sensitivity is usually accomplished by selecting a smaller thickness or a lower mass of the diaphragm. For a commonly used 1 5 micron thick diaphragm made of Mylar, the input referred vibration sensitivity would be about 63 dB SPL for a circular diaphragm If the rigid backplate is replaced with a flexible backplate, then the flexible backplate will also move due to external vibration. For low frequencies (i.e, below the resonance frequency of the backplate), this movement of the flexible backplate is designed to be in phase with the movement of the diaphragm. By choosing the right stiffness and mass of the backplate, the amplitude of the backplate vibration can match the amplitude of the diaphragm vibration and the output signal caused by the vibration can be cancelled. Further, because the backplate is made much thicker and heavier than the diaphragm, the backplate's acoustical compliance is much higher than the diaphragm's acoustical compliance. Thus, the influence of the flexible backplate on the acoustical sensitivity of the microphone is relatively small.

As an example, a polyimide backplate with a thickness of about 125 microns and a shape as shown in FIGS. 1–8 has a stiffness that is typically about two orders of magnitude greater than that of the diaphragm. The high stiffness prevents the backplate to move due to sound. The effective mass of the backplate in this example is about 50 times higher than the effective diaphragm mass and, thus, the vibration sensitivity is reduced by 6 dB. By adding some extra mass to the backplate, for example, by means of a small weight glued on its backside, the product of backplate mass and compliance can be matched to the diaphragm mass and compliance, and a further reduction of the vibration sensitivity can be achieved. The extra weight can also be added by configuring the backplate to have additional amounts of the material used for the backplate at a predetermined location Thus, the present invention contemplates the method of reducing the vibration sensitivity of a microphone The microphone has an electret assembly having a diaphragm that is moveable in response to input acoustic signals and a backplate opposing the diaphragm. The method includes adding a selected amount of material to the backplate to make the backplate moveable under vibration without substantially altering an acoustic sensitivity of the electret assembly. Alternatively, this novel method could be expressed as selecting a configuration of the backplate such that a product of an effective mass and a compliance of the backplate is substantially matched to a product of an effective mass and a compliance of the diaphragm. The novel microphone having this reduction in vibration sensitivity comprises an electret assembly having a diaphragm that is moveable in response to input acoustic signals and a backplate opposing the diaphragm. The backplate has a selected amount of material at a predetermined location to make the backplate moveable under operational vibration experienced by the microphone.

Figure 9A:
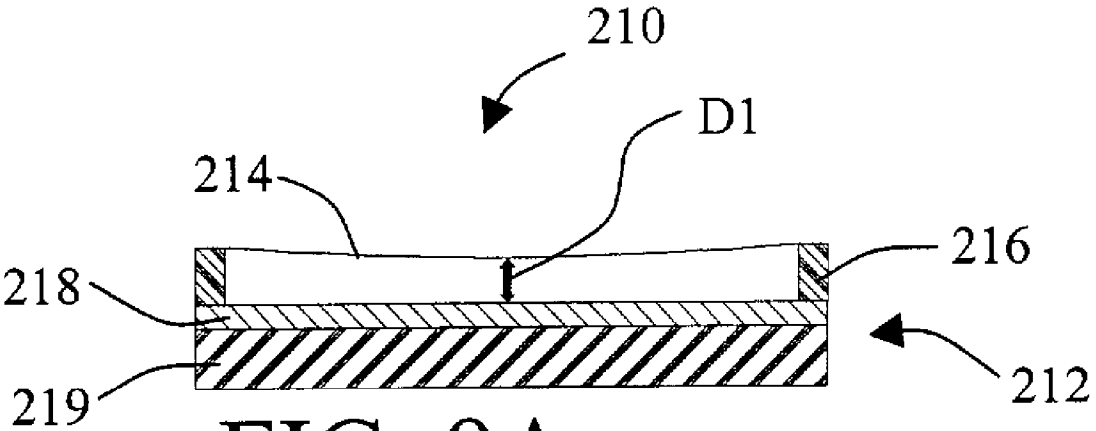
FIG. 9A illustrates a cross-sectional view of a typical prior art electret assembly that is used in a miniature microphone or listening device under low humidity conditions.

FIG. 9A illustrates a cross-sectional view of a prior art electret assembly 210 (also referred to as a "cartridge") that is commonly used in miniature microphones and listening devices. The working components of the electret assembly 210 include a backplate 212 and a diaphragm 214. The backplate 212 and the diaphragm 214 are separated by a spacer 216 located at the peripheries of the backplate 212 and the diaphragm 214.

The flexible diaphragm 214 is usually constructed of a polymer having a metallic coating on its side that faces the backplate 212. The polymer can be one of various types, such as Mylar, commonly used for this purpose. The thickness of the diaphragm 214 is usually about 1.5 microns. The metallic coating located on the diaphragm 214 is usually a gold coating with a thickness of about 0.02 microns The metallic coating of the diaphragm 214 is connected with the metal housing of the microphone, which is used as a common reference for the electrical signal.

The backplate 212 is typically comprised of a polymer layer 218 laminated on a metal carrier 219. The polymer layer 218 is permanently electrically charged so that movement of the diaphragm 214 relative to the backplate 212 causes a voltage between backplate and diaphragm corresponding to such movement The backplate 212 can be attached to an electrical lead which transmits the voltage signal corresponding to the movement of the diaphragm 214 relative to the backplate 212 from the electret assembly 210 to electronics that process the signal. The spacer 216 can be made of a nonconductive material so as to electrically isolate the diaphragm 214 from the backplate 212 The thickness of the spacer 216 defines the separation distance between the diaphragm 214 and the backplate 212 at their peripheries. The centers of the backplate 212 and the diaphragm 214 are separated by a distance D1. Under normal ambient conditions, for example, when the relative humidity is about 50%, the distance D1 is a few microns less than the thickness of the spacer 216. The exact distance D1 is determined by (i) the equilibrium of the electrostatic force between the charged backplate 212 and the diaphragm 214, and (ii) the tension of the diaphragm 214.

Figure 9B:
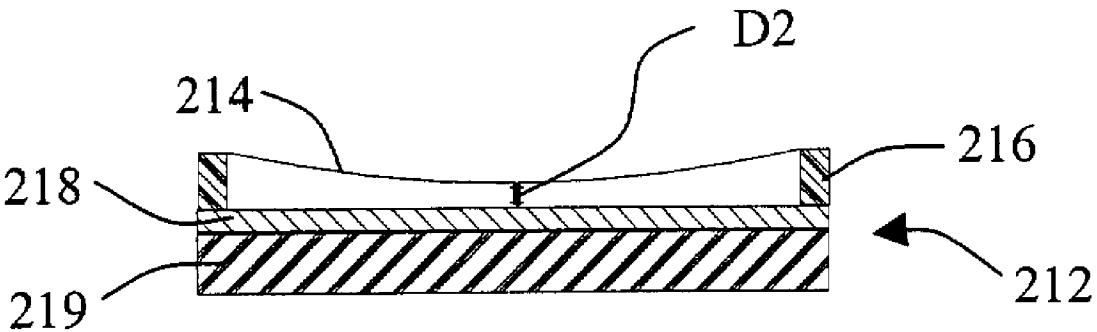
FIG. 9B illustrates the electret assembly of FIG. 9A under high humidity conditions

FIG. 9B illustrates the electret assembly 210 of FIG. 9A under high humidity conditions, such as when the relative humidity is greater than 80%. In response to this high humidity condition, the diaphragm 214 expands due to the hygroscopic expansion coefficient of the material comprising the diaphragm 214. The expansion of the diaphragm 214 relieves the tension within the diaphragm 214, causing the diaphragm 214 to sag towards the backplate 212. Considering the charged nature of the backplate 212, the sagging of the diaphragm 214 will be in the direction of the backplate 212 due to the electrostatic forces created by the backplate 212. Accordingly, under high humidity conditions, the centers of the diaphragm 214 and the backplate 212 are now separated by a distance D2 that is smaller than the distance D1 of FIG. 9A. It should be noted that all cross-sectional drawings of the electret assembly (including those in the subsequent figures), the bending of the diaphragm and backplate is exaggerated in order to illustrate the influence of the ambient humidity. The smaller distance D2 at high humidity conditions causes a larger electrical signal amplitude in response to a certain sound-induced diaphragm movement than when the distance D1 is present between the diaphragm 214 and the backplate 212. Thus, the microphone sensitivity, i.e., the output voltage amplitude as a function of the input sound pressure, is larger for high humidity conditions than for low humidity conditions.

Figure 10A:
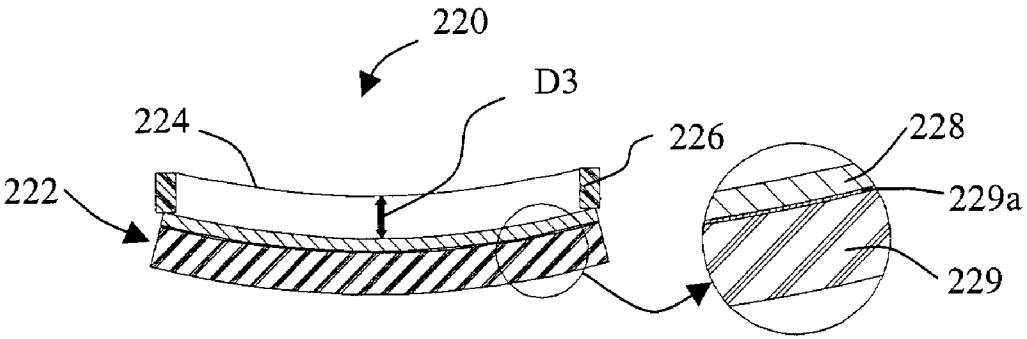
FIG. 10A illustrates a cross-sectional view of an electret assembly according to the present invention with a backplate made of two layers with different hygroscopic expansion under low humidity conditions, including a detail of the backplate composition.

FIG. 10A illustrates a cross-sectional view of an electret assembly 220 according to the present invention under normal humidity conditions The electret assembly 220 includes a diaphragm 224 moveable in response to incoming sound, a backplate 222 opposing the diaphragm 224, and a spacer 226 located between the backplate 222 and the diaphragm 224. The backplate 222 and the diaphragm 224 are separated from each other at their centers by a distance D3

Figure 10B:
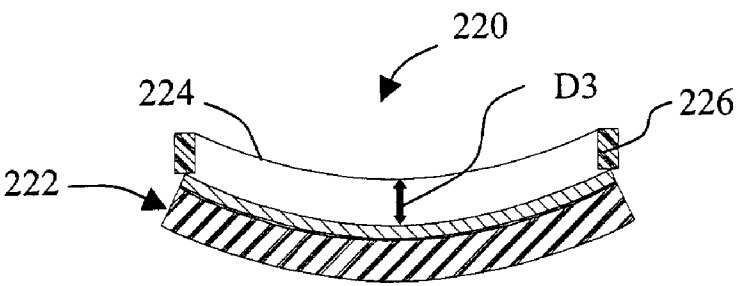
FIG. 10B illustrates the inventive electret assembly of FIG. 10A under high humidity conditions.
Figure 11B:
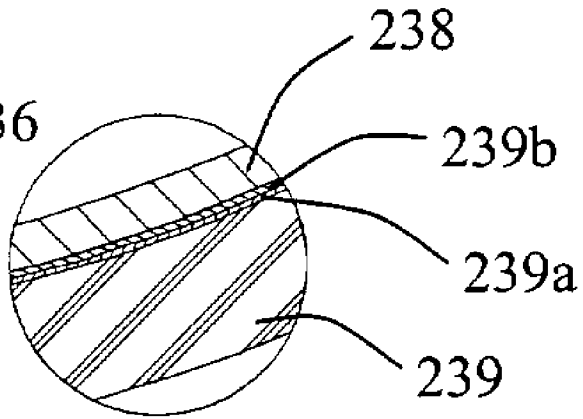
FIGS. 11A and 11B illustrate a cross-sectional view and expanded cross-sectional view, respectively, of an inventive electret assembly according to the present invention having an increased displacement of the backplate under high humidity conditions, including a detail of an alternative backplate composition
Figure 11A:
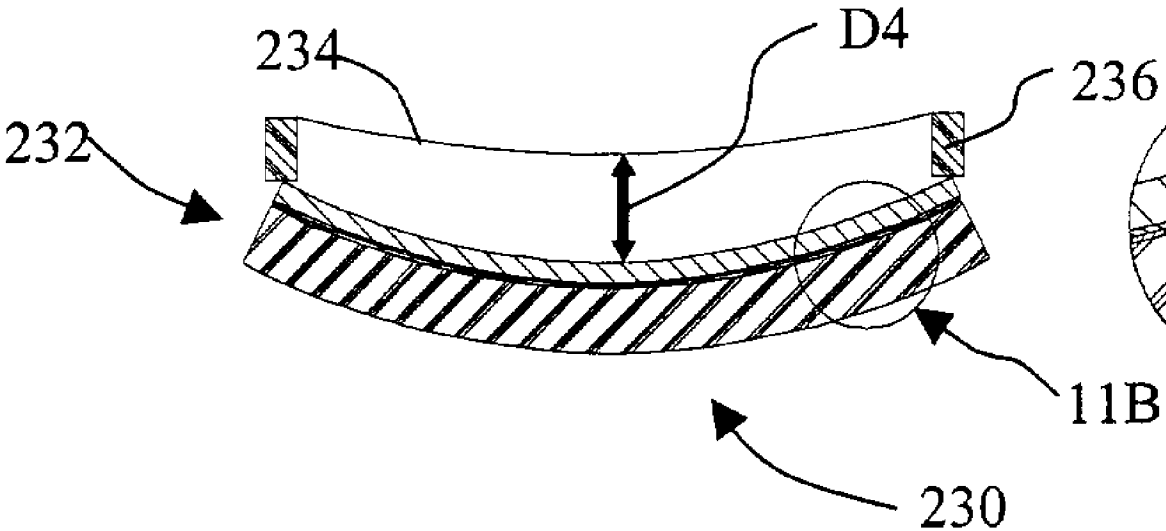

Unlike the prior art electret assembly 210 in FIG. 9, the backplate 222 includes a first layer 228 and a second layer 229, just as the electret assemblies 19 and 81 in FIGS. 1–8 have multiple layers The first layer 228 is a polymer that is permanently electrically charged. The second layer 229 is a polymer with a thin metallic coating 229*a* (e.g., gold) on the side opposing the first layer 228 to which the second layer 229 is laminated The metallic coating 229*a* is very thin, with a thickness on the order of about 0.10 microns, and is used for transmitting the signal from the charged first layer 228. The materials that comprise the first layer 228 and the second layer 229 have different coefficients of hygroscopic expansion Accordingly, the first layer 228 and the second layer 229 will expand differently when exposed to high humidity conditions. Because the first layer 228 and the second layer 229 are laminated together, the difference in the expansion causes the backplate 222 to bend by a known amount. The theory behind the bending of the backplate 222 caused by layers 228, 229 having dissimilar coefficients of hygroscopic expansion is similar to the theory of utilizing two layers of metals having dissimilar coefficients of thermal expansion as the working element within a common thermostat As shown in FIG. 10B, which illustrates the electret assembly 220 under high humidity conditions, the diaphragm 224 undergoes expansion, causing it to be displaced toward the backplate 222 Unlike FIG. 9B, however, the backplate 222 moves away from the diaphragm 224 due to the differing coefficients of hygroscopic expansion in the materials of the first layer 228 and the second layer 229. In addition to the differing coefficients of hygroscopic expansion, the dimensions (i.e., transverse dimensions and thickness) of the first and second layers 229, 228 are also taken into account in the analysis when selecting the materials for the first layer 228 and the second layer 229. Because of the predictability of the expansion caused by the materials in the first layer 228 and the second layer 229, the backplate 222 can be designed such that the backplate 222 and the diaphragm 224 remain separated by substantially the same distance, D3, as was experienced under low humidity conditions. Thus, the undesirable effects caused by higher humidity can be minimized in the electret assembly 220 according to the present invention FIG. 11A illustrates an alternative embodiment of an inventive electret assembly 230 The electret assembly 230 includes a backplate 232 and a diaphragm 234 separated by a spacer 236 As shown best in FIG. 11B, the backplate 232 includes a first layer 238 and a second layer 239 having a thin metallic coating 239*a* (e.g, gold) Additionally, a second polymeric coating 239*a* (e g., a PET film) is placed over the thin metallic coating 239*a* to ensure that no metallic contamination enters the first layer 238, which is charged Metallic contamination of the charged first layer 238 may cause a long-term charge loss. The first layer 238 and the second layer 239, which are laminated together, are selected to cause a larger displacement in the backplate 232 than the backplate 222 in FIG. 10. Thus, under high humidity conditions, the centers of the backplate 232 and the diaphragm 234 are separated by a distance D4 which is larger than the distance separating these components under normal ambient conditions.

The larger distance D4 in FIG. 11 serves an additional purpose in that it is useful in negating the undesirable effects of the increased acoustical compliance of the diaphragm 234 caused by high humidity conditions. In other words, in addition to the diaphragm 224 experiencing expansion under high humidity conditions, thereby causing an undesirable effect on the outputs of the microphone, the acoustical compliance of the diaphragm 234 increases, which also has an undesirable effect on the output of the microphone. This increased compliance (i.e, flexibility) causes the diaphragm 234 to move with a greater amplitude when subjected to a certain sound pressure level under high humidity conditions than when the diaphragm 234 is subjected to that same sound pressure level under normal humidity conditions. Consequently, the larger distance D4 created by the combination of the coefficients of hygroscopic expansion in the first layer 238 and the second layer 239 minimizes the undesirable effects of both the hygroscopic expansion and the increased compliance of the diaphragm 234 under high humidity conditions.

The following paragraphs illustrate examples that compare the characteristics of the prior art electret assembly 210 and the inventive electret assembly 230. In the first example, the backplate 212 and the diaphragm 214 of the prior art electret assembly 210 of FIG. 9 have diameters of about 1 7 mm. The metallic carrier 219 of the backplate 212 is made of a rigid, unitary material with negligible bending caused by an increase in relative humidity. Thus, the backplate 212 does not bend due to changes in the relative humidity. The diaphragm 14 is made of Mylar with a thickness of about 1.5 microns, and has a metallic layer of gold of about 0 02 microns. In this prior art electret assembly 210, the diaphragm 214 is displaced toward the backplate 212 by a distance of about 0.7 micron (0.0007 mm) per 10% increase in relative humidity Additionally, the increase in acoustic compliance of the diaphragm 214 under high humidity conditions causes the diaphragm 214 to move with larger amplitude when subjected to incoming sound waves. The compliance increases about 10% per 10% increase in relative humidity. Thus, the humidity coefficient of microphone sensitivity is about 0 05 to 0 06 dB per 1% increase in relative humidity.

In the second example, the backplate 232 and the diaphragm 234 of the inventive electret assembly 230 of FIG. 11 have diameters of about 1.7 mm. The diaphragm 234 has the same characteristics as those mentioned in the previous paragraph. The backplate 232 is comprised of a first layer 238 made of Teflon (fluorinated ethylene propylene) with a thickness of about 0 025 mm and a second layer 239 made of Kapton (polyimide) with a thickness of about 0.125 mm The hygroscopic expansion coefficient for Kapton is about 22 ppm per 1% RH, while the hygroscopic expansion coefficient for Teflon is essentially zero, relative to Kapton. As in the prior art example, the center of the diaphragm 234 moves toward the backplate 232 by approximately 0 7 microns per 10% increase in relative humidity In this inventive electret assembly 230, however, the center of the backplate 232 is displaced away from the diaphragm 234 by a distance of about 1.3 microns per 10% increase in relative humidity.

Accordingly, in the inventive electret assembly 230, an increase of 10% in the relative humidity causes the backplate 232 to be displaced by 0.6 microns further than the displacement of the diaphragm 234 (1.3 microns v. 0.7 microns) Breaking down the 1 3 micron displacement of the backplate 232, the first 0.7 micron displacement substantially negates the effect of the increased expansion that the diaphragm 234 experiences, while the additional 0.6 micron displacement assists in negating the effect of the increased compliance of the diaphragm 234. In terms of performance, a microphone incorporating the electret assembly 210 would have an effective humidity coefficient of the sensitivity of approximately 0 05 to 0.06 dB per 1% increase in relative humidity, while the electret assembly 230 would have an effective humidity coefficient of the sensitivity of approximately 0.03 dB per 1% increase in relative humidity.

In summary, the electret assembly 220 and the electret assembly 230 exhibit much lower humidity coefficients of the sensitivity than the prior art electric assembly 210, which has the rigid backplate 212. Additionally, since the distance D3 between the backplate and the diaphragm of assembly 220 and the distance D4 of assembly 230 is more constant than the distance D2 of the prior art assembly 210, the acoustic damping of the air gap is more constant for changes in relative humidity. Thus, both the peak frequency and the peak response have lower humidity coefficients, as well. Further, there is a reduced risk that the diaphragm will entirely collapse against the backplate under very high humidity conditions.

While an embodiment with 0.125 mm of Kapton for the second layer 229 or 239 has been discussed to reduce the humidity coefficient of the sensitivity to about approximately 0.03 dB per 1% increase in relative humidity, decreasing the Kapton to 0 050 mm will reduce the humidity coefficient of the sensitivity to approximately 0.01 dB per 1% increase in relative humidity. While this may result in a backplate 222 or 232 that is not rigid, it may be workable for some applications. Alternatively, a Kapton layer of 0.075 mm for the second layer 229 or 239 provides adequate rigidity for most applications and a significant reduction in the humidity coefficient. And, choosing a material that has a higher hygroscopic expansion coefficient than Kapton can result in a rigid backplate 222 or 232, while still providing a reduction in the humidity coefficient of sensitivity to less than approximately 0.03 dB per 1% increase in relative humidity.

Figure 12:
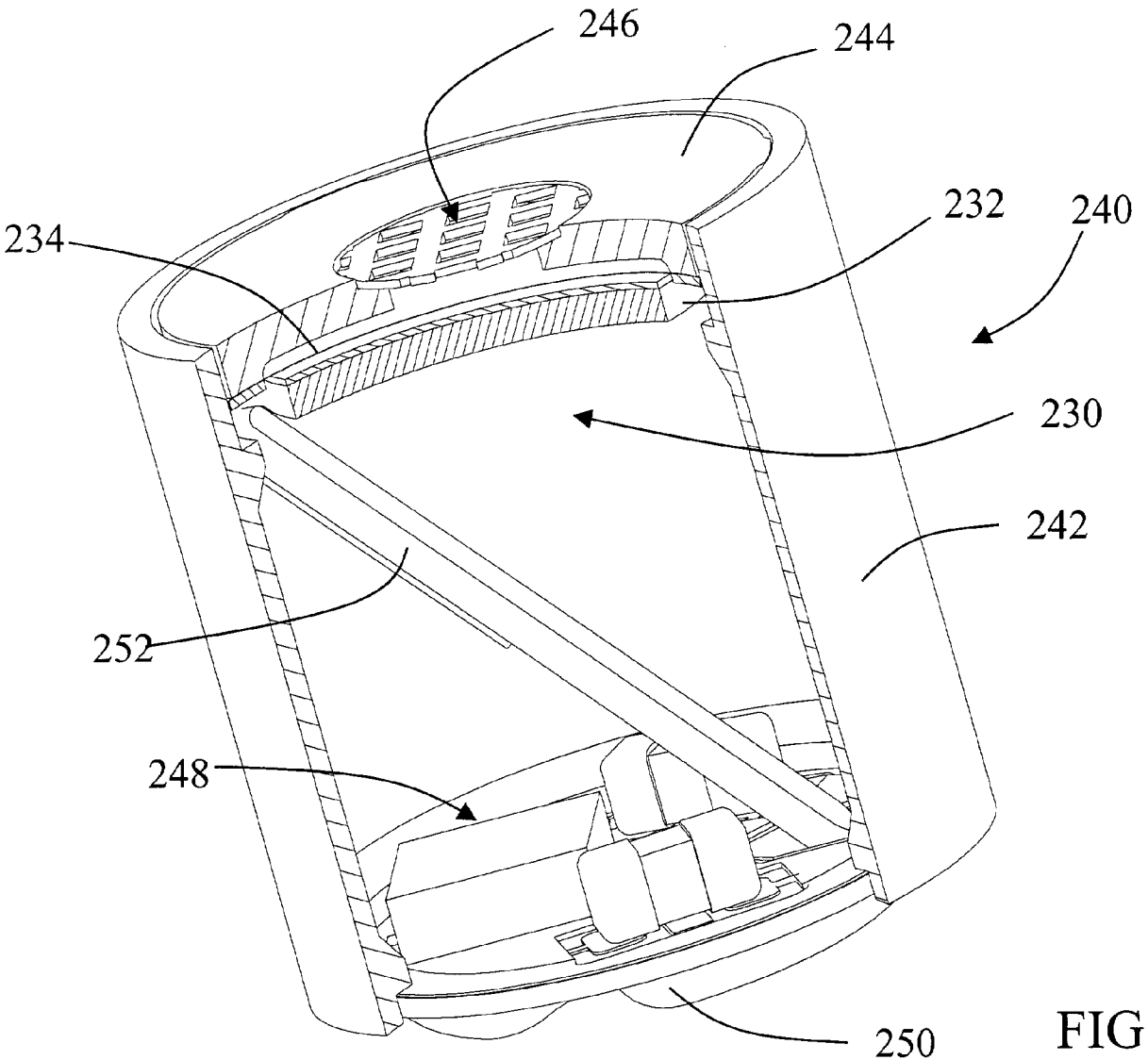
FIG. 12 illustrates one type of microphone incorporating the inventive electret assembly of FIGS. 10–11

FIG. 12 illustrates the electret assembly 230 assembled within a microphone 240 similar to the microphone in FIGS. 1–8. The microphone 240 includes a cylindrical housing 242 having a circular end cover 244. The end cover 244 has a sound port plate 246 with multiple sound ports for transmitting sound toward the diaphragm 234 of the electret assembly 230. At the opposite end of the housing 242, the microphone 240 includes internal electronics 248 that receive the signal from the electret assembly 230. In addition, the electronics 248 may also process the signal (e g., amplification). The electronics 248 are coupled to terminals 250 that transmit the processed signal from the microphone 240 to other components within the hearing aid or listening device. The terminals 250 also include at least one extra terminal for providing input power to the microphone 240.

It is commonly known to electrically couple the electret assembly 230 to the electronics 248 with a lead wire that is attached to the backplate 230 and the corresponding contact pad on the electronics 248. The inventive electret assembly 230 could employ such a connection. Alternatively, as shown in FIG. 12, the backplate 230 may include an integral connecting element 252 that is made of the same material as the backplate 230. This integral connecting element 252 makes electrical contact with a contact pad on the electronics 248 to provide the electrical connection between the electret assembly 230 and the electronics 248 (like the integral connecting element in FIGS. 1–8).

Because the electret assemblies 220 and 28 result in a more flexible backplate, as opposed to a rigid backplate, they also reduce the vibration sensitivity of the microphone. The flexible backplate tends to move at the same frequency and amplitude as the diaphragm when subjected to certain mechanical vibrations, thereby minimizing the undesirable effects that external vibration can have on a microphone. The inventive electret assembly, which minimizes the undesirable effects of the ambient humidity on the microphone, can be used in combination with a flexible backplate that reduces vibration sensitivity.

Figure 13A:
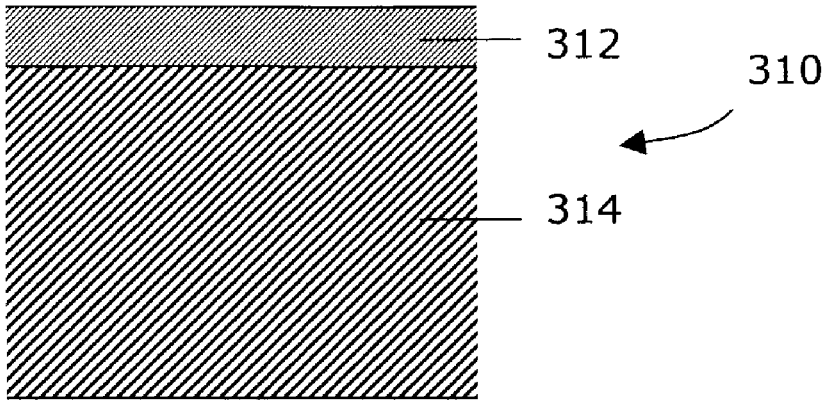
Fig. 13A (Prior Art)
FIGS. 13A–13B illustrate a cross-sectional view of prior art backplates.

FIG. 13A illustrates a cross-sectional view of a prior art backplate 310 that includes a charged layer 312 and a metallic plate 314 The charged layer 312 is typically made of fluorinated ethylene propylene ("FEP") and the metallic plate 314 is typically made of stainless steel. In operation, the charged layer 312 is positioned opposite a movable diaphragm. As incoming acoustical signals cause the diaphragm to move relative to the charged layer 312, a signal is produced corresponding to that movement The metallic plate 314 acts as an electrode to conduct the signal away to other electronics in the microphone.

Figure 13B:
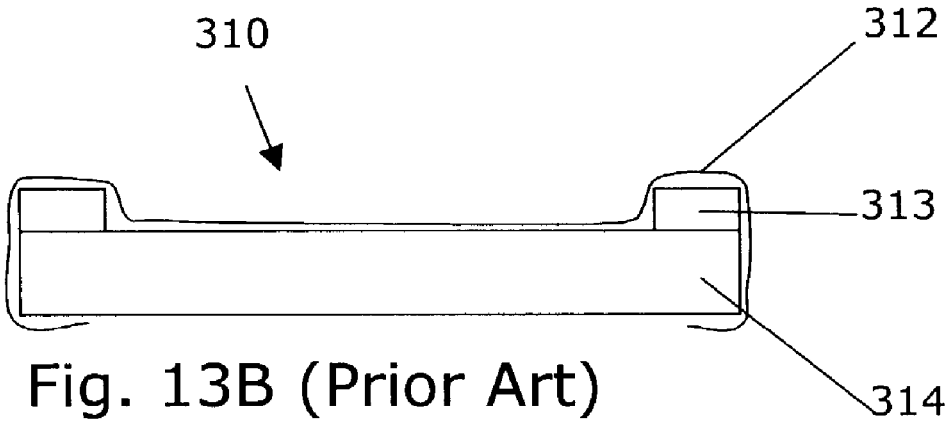
Fig. 13B (Prior Art)

FIG. 13B is a side view of the backplate 310 that illustrates how the backplate 310 is made The transducing assembly that includes the backplate 310 further comprises a spacer element 313. The spacer element 313 is a structure on which the movable diaphragm is placed to keep a known distance separating the backplate 310 and the movable diaphragm. To create the charged layer 312 on the metallic plate 314, a film of the charged layer 312 is placed over the metallic plate 314 and the spacer element 313. The film is then heat sealed to both the spacer element 313 and the metallic plate 314.

Figure 13C:
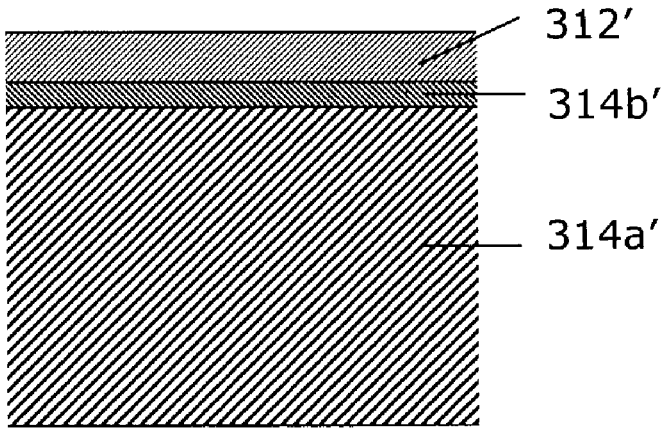
FIG. 13C illustrates a cross-sectional view of a backplate like the one shown in FIG. 5, 10 or 11.

In yet another backplate shown in FIG. 13C, the backplate 310' includes a charged layer 312', a conductive layer 314*a*', and a non-conductive layer 314*b*' Thus, the difference between FIG. 13C and FIGS. 13A–13B resides in the conductive member The conductive plate 314 in FIGS. 13A–13B is replaced by a conductive layer 314*a* located on a non-conductive layer 314*b*'. The conductive layer 314*a*' can be gold, and the non-conductive layer 314*b*' can be a polymer, such as polyimide. This is similar to the backplates shown in FIGS. 5, 10 and 11.

In each of these backplates 310, 310' the charged layer 312, 312' is exposed to various foreign materials that may contact and/or infiltrate the charged layer 312, causing it to lose its charge. The physical contact with foreign materials can be in the form of moisture or dirt on the exposed upper surface of the charged layer 312, 312'

Second, the charge degradation can be caused by infiltration of holes from the conductive member entering the back surface of the charged layer 312, 312'. When the charged layer 312, 312' is negatively charged, the conductive member can release a positive charge (i.e, "holes" as opposed to electrons), thereby tending to cancel the negative charge in the charged layer 312, 312' It should be noted that the stainless steel plate 314 may cause less charge degradation than the gold conductive layer 314*b*'.

Furthermore, extreme environmental conditions, such as high humidity in high temperature, may cause the charged layer 312, 312' to lose its charge. Exposure to ultraviolet energy may cause charge degradation, as well.

Figure 14A:
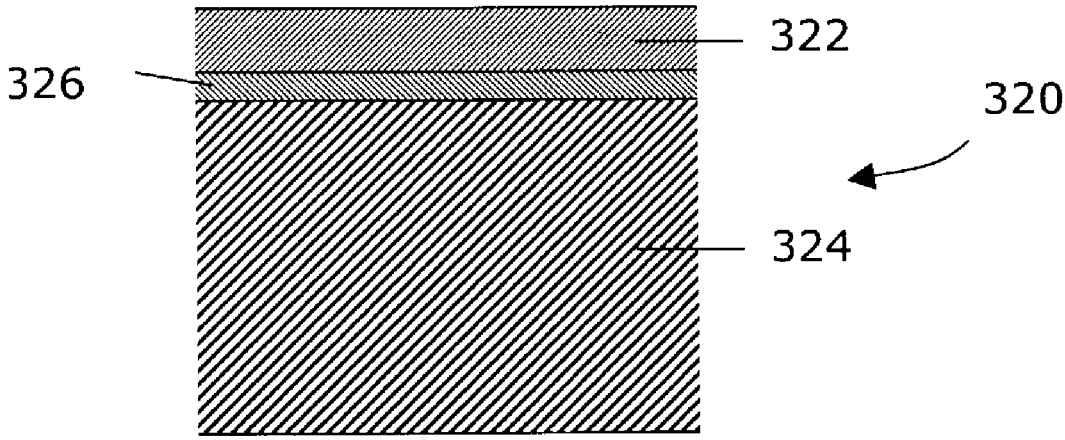
FIG. 14A illustrates a cross-sectional view of a first embodiment of the present invention.

FIG. 14A illustrates one embodiment of the present invention in which a backplate 320 includes a charged layer 322 and a metallic plate 324. To inhibit the migration of positive charge from the metallic plate 324 into the charged layer 322 (assumed to be negatively charged), a protective layer 326 is located between the metallic plate 324 and the charged layer 322. The protective layer 326 is typically a polymeric material, such as polyethylene. When the backplate 320 is negatively charged, the material of the protective layer 326 is preferably one that has a relatively low "hole" conductivity in that it must be able to inhibit the infiltration of positive charges in the form of "holes" from the metallic plate 324 to the charged layer 322. Polyethylene terephthalate (PET) meets this characteristic very nicely. The protective layer 326 is very thin, so as to minimize the reduction in capacitance of the backplate 320. In one preferred embodiment, the protective layer 326 is PET with a thickness that is less than 5 microns, for example, about 1.5 microns. When the backplate 320 is positively charged, the material of the protective layer 326 is preferably one that has a relatively low "electron" conductivity in that it must be able to inhibit the infiltration of negative charges in the form of "electrons" from the metallic plate 324 to the charged layer 322.

Figure 14B:
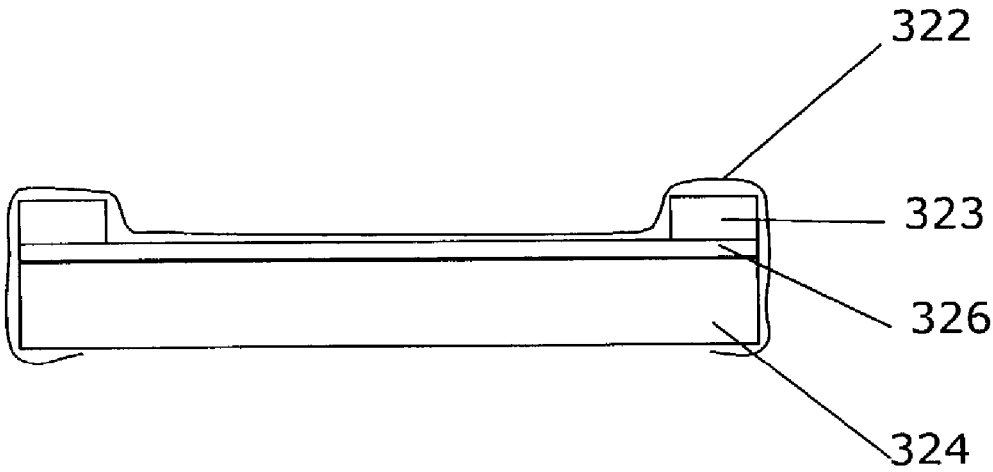
FIGS. 14B–14C illustrate methods for developing the backplate of FIG. 14A.

FIG. 14B illustrates one manner in which the embodiment of FIG. 14A can be manufactured. As shown, the metallic plate 324 has a protective layer 326 placed on its surface, possibly through a lamination process. A spacer element 323, which is used to maintain a known distance between the backplate 320 and the moveable diaphragm, is then placed on the protective layer 326. Finally, a film of material that is to be the charged layer 322 (e.g., FEP) is placed over the protective layer 326 and the spacer element 323. The film may extend entirely around the metallic plate 324 such that it is attached to the back side of the metallic plate 324. The film is then heat sealed to the protective layer 326 and the spacer element 323 to create the charged layer 322. The film can then be subjected to a process (e.g., corona charging) to create the charge in its structure This process may require multiple charge-inducing steps to achieve the desired charge, thereby causing thermal cycling in the layers.

Figure 14C:
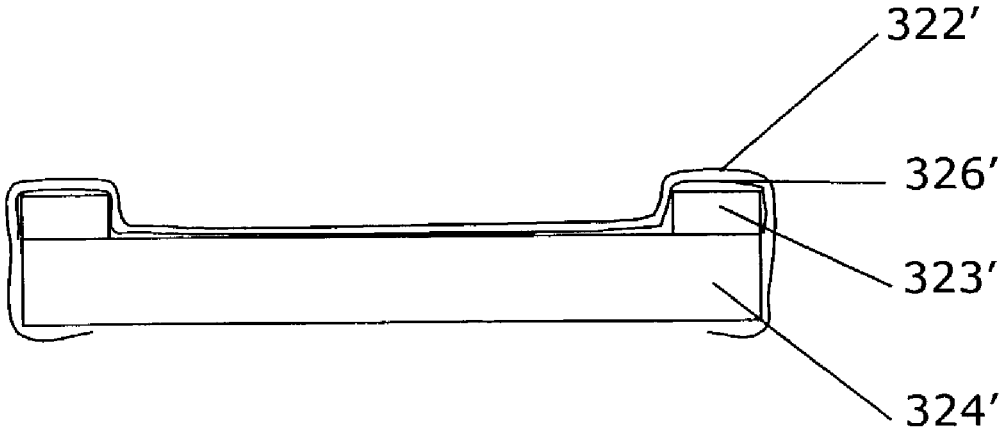

FIG. 14C illustrates another embodiment for creating the backplate 320 in FIG. 14A. In FIG. 14C, a metallic plate 324' is in direct contact with the spacer element 323'. The protective layer 326' is in the form of a film that is placed over the spacer element 323' and the metallic plate 324'. Next, the charged layer 322', which is in the form of a film, is placed over the protective layer 326' The protective layer 326' and the charged layer 322' are then heat sealed to the spacer element 323' and the metallic plate 324'.

Figure 15:
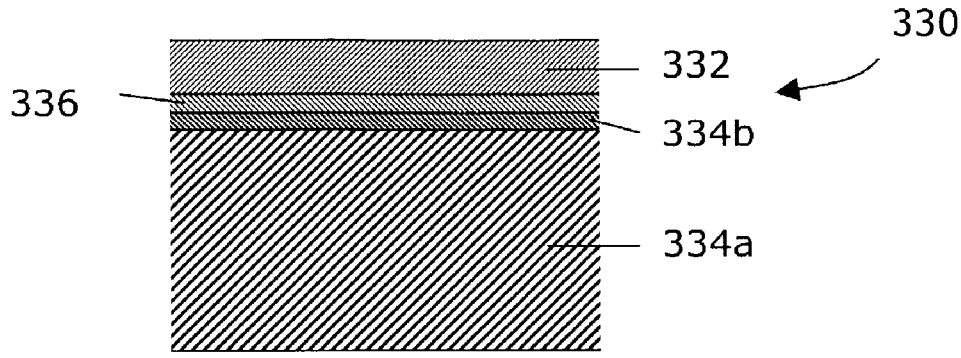
FIG. 15 illustrates another embodiment of the backplate according to the present invention.

FIG. 15 illustrates an alternative backplate 330 where the conductive member is in the form of a thin layer The backplate 330 includes a charged layer 332, a nonconductive layer 334*a*, and a conductive layer 334*b*. Additionally, a protective layer 336 is located between the conductive layer 334*b* and the charged layer 332. The conductive layer 334*b* is typically a thin layer of gold, or other highly conductive material. The conductive layer 334*b* is placed on the nonconductive layer 334*a*, which is usually a polymeric material such as polyimide. Therefore, the protective layer 336 inhibits the infiltration of undesirable charges from the conductive layer 334*b* into the charged layer 332.

Figure 16:
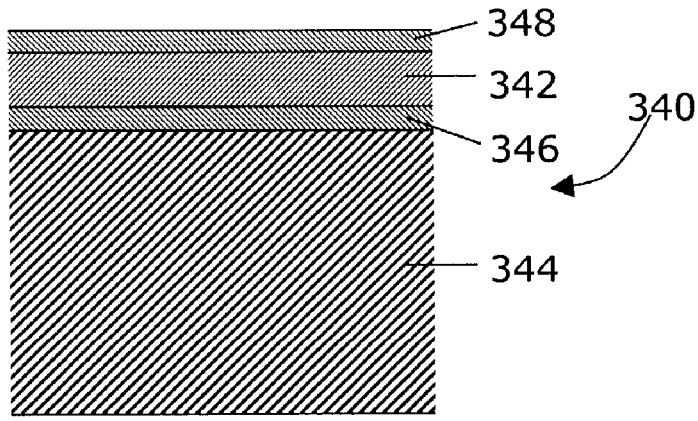
FIG. 16 illustrates a further embodiment of the backplate according to the present invention

FIG. 16 illustrates an alternative backplate 340 according to the present invention. The backplate 340 includes a charged layer 342 and a metallic plate 344. Unlike the previous embodiments, an inner protective layer 346 is located on the lower surface of the charged layer 342 and an outer protective layer 348 is located on the upper surface of the charged layer 342. The inner protective layer 346 inhibits the infiltration of the undesirable charges from the metallic plate 344

On the other hand, the outer protective layer 348 inhibits the contact of other foreign materials (usually environmental contaminants such as moisture or dirt) on the charged layer 342. These foreign materials typically carry an inherent ionic charge that affects the overall charge of the charged layer 342 Additionally, the foreign materials located on the upper surface of the charged layer 342 may "short circuit" the surface charge. The outer protective layer 348 is preferably hydrophobic (e.g., FEP, PTFE), or at least has a low moisture absorption coefficient (e.g, PET, polypropylene) so that it tends not to absorb water. A preferable material having a low moisture absorption coefficient is one with a <1% absorption according to ASTM D570. The outer protective layer 348 can be made very thin, for example, about 12.5 microns. Consequently, the charged layer 342 is protected on both of its major surfaces, thereby increasing the likelihood that the charged layer 342 will maintain a constant charge over its operating life.

Figure 17:
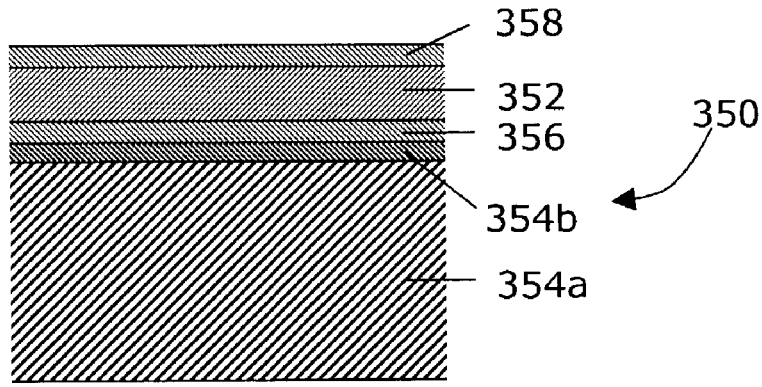
FIG. 17 illustrates yet another embodiment of the backplate according to the present invention.

FIG. 17 illustrates yet a further alternative that is similar to FIG. 16, except the conductive member is a thin conductive layer and not a conductive plate. A backplate 350 includes a charged layer 352, a non-conductive layer 354*a*, and a conductive layer 354*b*. An inner protective layer 356 is located on the lower surface of the charged layer 352. Furthermore, an outer protective layer 358 is located on the upper surface of the charged layer 352. As with the embodiment of FIG. 16, the charged layer 352 is protected on both of its major surfaces from the infiltration of holes or foreign materials that may cause it to lose its charge.

The backplates in FIGS. 16–17 have been shown as having a protective layer on both surfaces of the charged layer. It should be noted, however, that the present invention contemplates using a protective layer on only the outer surfaces of the charged layer (i.e., layers 348, 358). This may be useful, for example, when the materials of the charged layer and the conductor, or the interface characteristics between these components, tend to inherently inhibit the migration of holes (or electrons) from the conductor to the charged layer.

Regarding the interface characteristics between the charged layer and the conductor, this parameter is also a factor in determining the rate at which the charge of the charged layer will degrade over time When the surface topography of the conductor is such that there is an array of conically shaped irregularities on the surface of the conductor, the conductor has a better path to allow charges to enter into the charged layer. The conical irregularities act like a funnel through which the charges (e.g., holes) may pass to enter the charged layer When the conductor surface has a topography where the tips of the conically shaped irregularities are flattened, however, the conductor is less prone to transfer holes into the negatively charged layer For example, a gold-polyimide film (Sheldahl Corporation of Northfield, Minn., Product No G404950, VD Gold×5 mil PI) is useful as the conductor by providing, for example, the layers 334*a*, 334*b* in FIG. 15 and the layers 354*a*, 354*b* in FIG. 17. The gold layer in this product has been shown to have a relatively uniform array of cone-shaped irregularities where the peak-to-valley heights of the majority of the irregularities are between about 8 nm and about 15 nm, and the tips of the cones (or micro-peaks) have radii of curvature that are less about 50 nm, and usually between about 30 nm and about 40 nm. By further processing this gold-polyimide tape to smooth these micro-peaks (i.e., to increase the radii of curvature of the micro-peaks), the micro-peak radii can be made to be 100 nm or more, which improves the charge stability. The processes that can be used to smooth the surface are vacuum deposition of metal to previously deposited gold layer, galvanic metal coating, and/or polishing. It is believed that providing a conductor surface where the micro-peak radii are larger than about 200 nm will further improve charge stability.

The backplates 330, 340, 350 in FIGS. 15–17 can be made in various ways. For example, the protective layers can be in the form of films that are placed over each other and heat sealed to each other. The outer protective layers 348, 358 in FIGS. 16–17, however, are preferably heat sealed after the charging of the charged layer has taken place. As the elevated temperatures during heat sealing can cause charge degradation, minimizing the duration of heat being applied is advisable as well as choosing a material, such as polypropylene, that has a lower melting temperature.

Figure 18:
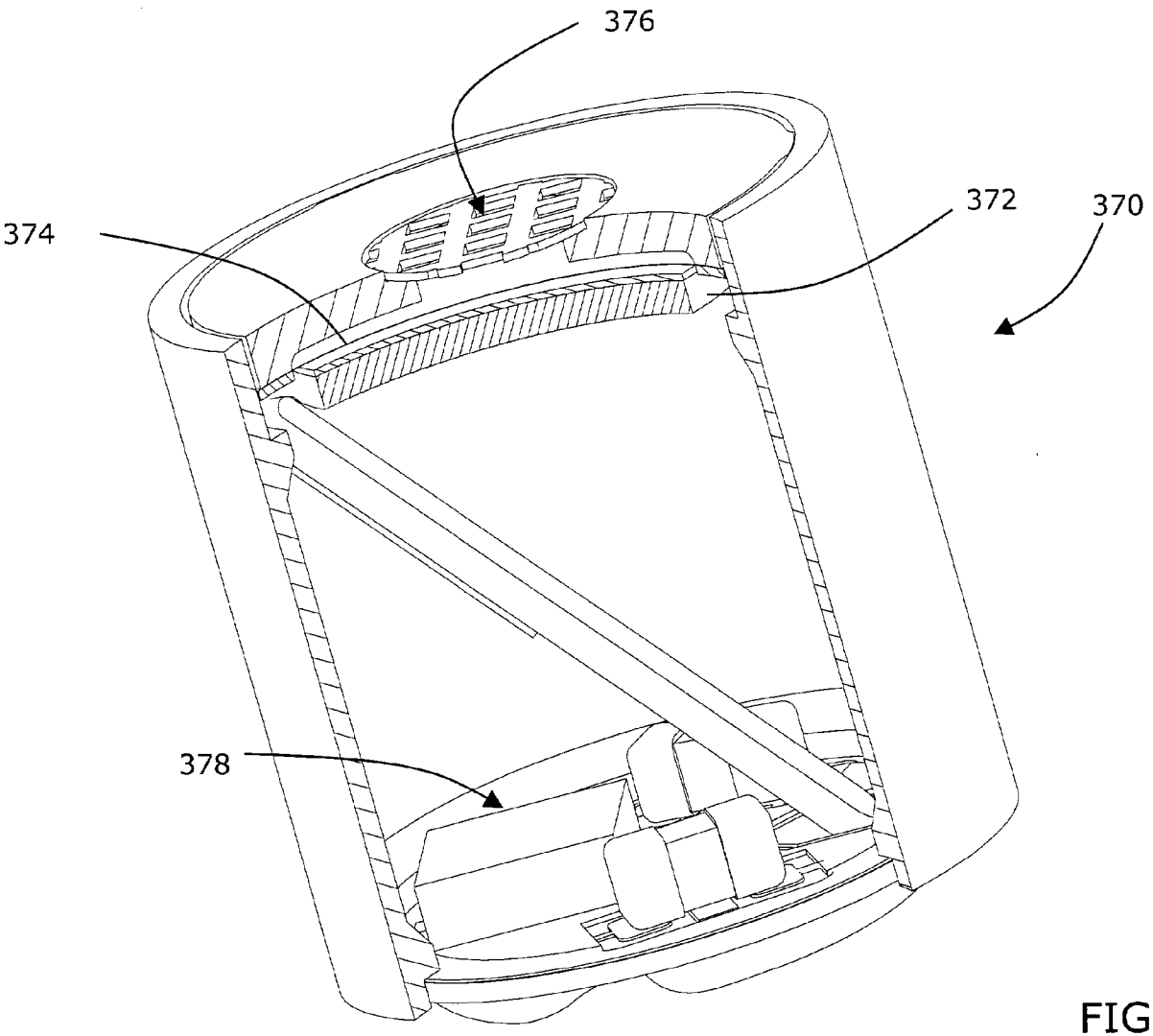
FIG. 18 illustrates a microphone that includes a backplate according to the present invention illustrated in FIGS. 14–17

FIG. 18 illustrates a microphone 370 according to the present invention. The microphone 370 includes a backplate 372 having a protective layer(s) that assists it with maintaining a relatively constant charge throughout its operating line, as discussed with respect to FIGS. 14–17. The backplate 372 opposes a diaphragm 374 which moves in response to incoming sound that enters the microphone 370 via a sound port 376. The audio signal produced by movement of the diaphragm 374 relative to the backplate 372 is then received by electronics 378 located within the microphone 370. The electronics 378, which may process the audio signal, then transmit the audio signal from output terminals located on the microphone 370. The microphone 370 is cylindrical in shape, but the inventions described in FIGS. 14–17 are useful in a rectangular microphone (or any shaped microphone), or any electroacoustic transducer having the need for a permanently charged layer.

Further, this aspect of the invention which improves the charge stability of the backplate is also combinable with the other inventions described with reference to FIGS. 1–12, such as the integral connecting wire for the backplate and/or the multilayer backplate that compensates for the diaphragm's movement under high humidity conditions by use of materials with different hygroscopic expansion coefficients.

While the charge-stability invention has been described with respect to a single microphone, its advantages are useful in directional microphones, whether the directional microphone is in the form of two different microphones matched together or a single microphone housing with two electret assemblies Because the protective layers provide for a more stable charge on the backplate, matching of the pairs of microphones or electret assemblies can be guaranteed for longer periods of time.

While the present invention has been described with reference to one or more particular embodiments, those skilled in the art will recognize that many changes may be made thereto without departing from the spirit and scope of the present invention. By way of example, the inventive electret assemblies could be used in a directional microphone. Each of these embodiments and obvious variations thereof is contemplated as falling within the spirit and scope of the claimed invention, which is set forth in the following claims.

What is claimed is:

1. A transducer for transducing between an acoustic signal and an audio signal, comprising:

a housing; and an electret assembly located in said housing and having a moveable member and a stationary member, said moveable member being moveable relative to said stationary member, at least one of said stationary member and said moveable member including a charged layer, a metallic conductor, and a protective polymeric layer between said charged layer and said metallic conductor for inhibiting the infiltration of undesirable charges from said metallic conductor into said charged layer that affect the charge in said charged layer.

2. The transducer of claim 1, wherein a plurality of surfaces of said charged layer includes said protective polymeric layer thereon.

3. The transducer of claim 1, further including another protective polymeric layer is located on an outer surface of said charged layer for inhibiting contact between environmental contaminants and said outer surface.

4. The transducer of claim 1, wherein said charged layer is fluorinated ethylene propylene.

5. The transducer of claim 1, wherein said conductor is a thin layer of gold.

6. The transducer of claim 1, wherein said protective layer is polyethylene terephthalate (PET).

7. A transducer for transducing between an acoustic signal and an audio signal, comprising:

a housing; and an electret assembly located in said housing and having a moveable member and a stationary member, said moveable member is a diaphragm being moveable relative to said stationary member, said stationary member is exposed to said diaphragm and includes a charged layer, a conductor that cooperates with said charged layer, and a protective polymeric layer between said conductor and said charged layer, said protective polymeric layer for inhibiting the infiltration of undesirable charges from said conductor into said charged layer that affect the charge in said charged layer.

8. The transducer of claim 7, wherein said charged layer is fluorinated ethylene propylene.

9. The transducer of claim 7, wherein said conductor is a thin layer of gold.

10. The transducer of claim 7, wherein said protective layer is polyethylene terephthalate (PET).

11. The transducer of claim 10, wherein said charged layer is negatively charged.

12. The transducer of claim 7, wherein said conductor is a stainless steel plate.

* * * * *